United States Patent [19]

Thornton et al.

[11] 4,078,103

[45] Mar. 7, 1978

[54] METHOD AND APPARATUS FOR FINISHING MOLTEN METALLIC COATINGS

[75] Inventors: John A. Thornton, Los Angeles County, Calif.; Thomas A. Compton, Butler County, Ohio

[73] Assignee: Armco Steel Corporation, Middletown, Ohio

[21] Appl. No.: 733,213

[22] Filed: Oct. 18, 1976

Related U.S. Application Data

[63] Continuation of Ser. No. 568,929, Apr. 17, 1975, abandoned.

[51] Int. Cl.[2] ..... C23C 1/00

[52] U.S. Cl. ..... 427/349; 427/431; 427/433; 118/63

[58] Field of Search ..... 118/63; 427/349, 431

[56] References Cited

U.S. PATENT DOCUMENTS

| | | | |
|---|---|---|---|
| 3,459,587 | 8/1969 | Hunter et al. | 427/431 |
| 3,681,118 | 8/1972 | Ohama et al. | 427/349 |
| 3,753,418 | 8/1973 | Roncan | 118/63 |
| 3,803,033 | 4/1974 | Mayhew | 427/349 |
| 3,841,557 | 10/1974 | Atkinson | 118/63 X |
| 3,917,888 | 11/1975 | Beam et al. | 118/63 X |

*Primary Examiner*—Ralph S. Kendall
*Attorney, Agent, or Firm*—Melville, Strasser, Foster & Hoffman

[57] ABSTRACT

A method of finishing a molten metallic coating on metallic strip wherein an elongated subsonic fluid jet, preferably ambient air, is impinged across the molten coating on the upwardly moving strip, the narrow dimension of the jet being increased progressively from the center to each end thereof by contouring the nozzle orifice through which the jet is discharged, adjusting the distance from the nozzle orifice to the strip relative to the narrow dimension of the orifice adjacent the strip edge to satisfy the relation $Z_o = \phi d$ where $Z_o$ = distance from orifice to strip $\phi$ = length of near-field region, expressed as a multiple of $d$ $d$ = narrow dimension of orifice at strip edge, and minimizing the ratio of fluid jet pressure to ambient pressure for a desired minimum coating thickness, whereby to obtain optimum finishing performance and to minimize ripples and edge build-up of coating metal. A high efficiency nozzle is disclosed wherein $\phi$ = 8 to 10 in the equation $Z_o = \phi d$.

12 Claims, 12 Drawing Figures

COATING MATERIAL = ZINC
JET FINISHING FLUID = AIR
TWO DIMENSIONAL KOHLER-TYPE NOZZLE
STRIP SPEED, U=50 fpm
NOZZLE -TO- STRIP DISTANCE, $Z_o$ = 1/2 INCH
NOZZLE SLOT d = 0.032 INCH

METHOD AND APPARATUS FOR FINISHING MOLTEN METALLIC COATINGS

This is a continuation of application Ser. No. 568,929, filed Apr. 17, 1975, now abandoned.

BACKGROUND OF THE INVENTION

1. Field of the Invention

This invention relates to a method and apparatus for controlling the thickness of a liquid coating on a substrate, and more particularly hot dip coating of molten metal on a continuous substrate of ferrous strip. In particular, this invention provides an analytical description of a process wherein an elongated fluid jet is caused to impinge transversely across the entire surface of the upwardly moving coated strip at a distance above the molten coating metal bath, where the coating on the strip is still molten, and where said impinging fluid flow is of such a nature that it forms an effective dam which acts to control the thickness of coating material which is permitted to pass through the impinging jet flow. The present invention provides guide-lines for adjusting the essential control parameters so that optimum performance can be obtained for a given coating system. The analytical description also provides criteria for the design of new coating systems configured to operate at high line speeds, and for the design of effective nozzles. Operation in accordance with the teachings of the invention provides optimum control of coating thickness together with minimization of ripples and build-up of thick edge coatings.

2. Description of the Prior Art

The use of an elongated fluid jet, or so-called "air knife", to control the thickness of coatings applied to paper webs has long been known. Somewhat more recently, the application of such fluid jets to control the thickness of molten metal coatings on metallic substrates has been the subject of considerable investigation. Reference may be made to the following U.S. Pat. Nos. which relate to methods and apparatus for control of molten metal thickness by means of elongated fluid jets:

3,314,163 — issued Apr. 18, 1967 to J. B. Kohler
3,406,656 — issued Oct. 22, 1968 to R. W. Patterson
3,459,587 — issued Aug. 5, 1969 to D. L. Hunter et al
3,480,469 — issued Nov. 25, 1969 to R. S. Shaffer
3,494,324 — issued Feb. 10, 1970 to R. L. Bauer et al
3,499,418 — issued Mar. 10, 1970 to J. T. Mayhew
3,526,204 — issued Sept. 1, 1970 to P. E. Schnedler et al
3,753,418 — issued Aug. 21, 1973 to R. Roncan
3,808,033 — issued Apr. 30, 1974 to J. T. Mayhew The above-mentioned Mayhew patents disclose an apparatus and method for continuous hot dip metal coating of metallic strip wherein a linearly extended gas outlet means is provided for each surface of the strip, the gas outlet means comprising nozzle means shaped to deliver a concentrated stream of heated gas under pressure across the width of the strip in a direction substantially perpendicular to the opposed planar face thereof, and wherein means is provided for continuously controlling the mass of gas supplied to the nozzle means. Each nozzle means is positioned in substantially direct opposition to the other nozzle means, so that both impinge a stream of gas against opposite planar surfaces of the strip in substantially the same plane.

The nozzle structure disclosed by Mayhew is a two-dimensional converging nozzle incorporating a very narrow, elongated constant-gap channel or throat having a gap or height of 0.005 to 0.015 inch. The channel inlets are square, thereby introducing vena contracta losses. The channel length-to-gap or height ratio is large, thereby causing relatively large frictional pressure losses. The narrow channel gap causes the nozzle to become sonically choked at the flow rates and momentum fluxes necessary for effective jet finishing of molten coating metal and requires the use of high nozzle plenum pressures (20 to 55 psig). Because of the sonic flow at the nozzle exit a static pressure gradient and undesirable lateral expansion or divergence of the free jet would be expected to occur in the region adjacent to the nozzle exit. The high plenum pressures required to overcome the various losses preclude the use of air from conventional multi-stage centrifugal blowers as a jet finishing medium.

In the Mayhew apparatus the distance between the nozzle exit and the pass line of the coated strip varies from about 0.25 to 1.25 inches, and the nozzles may be positioned about 4.5 to 5.5 inches above the coating metal bath level.

The Mayhew patents suggest that line speeds considerably faster than 400 feet per minute should be possible.

In the above-mentioned Hunter et al patent, a molten coating metal weight-control method and apparatus are disclosed, which are alleged to avoid edge build-up or edge bead of coating metal. Broadly, the method comprises impinging gaseous streams (preferably air at ambient temperature) against opposite surfaces of coated strip in such manner that the impingement height of the respective gas streams are overlapping, but offset from each other by an amount of from 1/20 to $\frac{3}{4}$ the impingement height.

The Hunter et al. patent teaches the use of a nozzle having a large throat-length-to-gap ratio (similar to Mayhew). Such an elongated channel can be expected to introduce undesirable frictional pressure losses. The nozzle gap is adjustable through the use of variable sized throat section inserts.

The minimum air pressure in the Hunter et al. nozzle is 0.4 psig, exemplary pressures being 15 inches of water (0.55 psi) and 30 inches of water (1.1 psi). It is stated that higher air pressures are required for smaller nozzle orifices (e.g., 0.02 inch) and lower pressures for larger orifices (e.g., 0.25 inch).

Nozzle gap openings between 0.02 inch and about 0.25 inch have proved satisfactory according to Hunter et al. Coating weight is taught to be controlled without impairing the appearance of the coating, while using a given nozzle gap opening, by controlling the flow rate through variations in the nozzle plenum pressure. It is stated that lighter coating weights can be produced at any given line speed by increasing the pressure within the nozzles at a rate that is inversely proportional to the desired change in coating weight. Alternatively, for a given strip speed, nozzle-to-strip distance, and orifice pressure, a decrease in coating weight can be achieved with an increase in the nozzle gap opening.

However, Hunter et al also teaches that for a given orifice height, there is a difference in coating uniformity as the nozzle-to-strip distance is increased. Coatings produced with a nozzle-to-strip distance of $\frac{1}{2}$ inch are reported to be uniform in appearance, while those produced with a nozzle-to-strip distance of 1-inch exhibit a faint transverse wave pattern, and those at distances greater than about 1½ inches exhibit a more pronounced wave pattern. Although nozzle-to-strip distances of about ¼ to 1½ inches are stated to be preferred, and nozzle slot heights of 0.06 to 0.15 inch are preferred for galvanizing operations, no guidelines are given between particular values of the nozzle slot height and the resultant ranges in nozzle-to-strip spacings which yield coatings of good appearance. However, it is stated that with all other operating variables being constant, the coating weight of the strip, after passing through the gas streams, can be considered directly proportional to the line speed.

The above-mentioned Roncan patent discloses coating weight control apparatus including the nozzle means comprising a pair of lip members, the lower lip being deformable to vary the longitudinal profile of the nozzle orifices. The nozzle opening in the Roncan structures varies between 0.5 to 1.5 mm (0.02–0.06 inch), the nozzle-to-strip distance between 12 and 18 mm (0.47–0.71 inch), and the air pressure between 600 and 1800 mm of water (0.89–2.67 psi). The height of the nozzles above the coating metal bath varies between 150 and 500 mm (5.9–19.6 inches), and the pair of nozzles on opposite sides of the strip are slightly staggered with respect to each other, with one nozzle impinging perpendicularly on the strip and the other preferably inclined downwardly at an angle of about 80° to the strip, or 10° below horizontal. Ambient air is used as the fluid.

British Pat. No. 1,304,532, dated June 25, 1970, in the name of Armco Steel Corporation (a patent of addition to British Pat. No. 1,221,349), discloses a method of finishing a molten metallic coating on a ferrous metal strip by impinging a laminar flow jet of gaseous fluid on the surface of the coated strip which is maintained flat at the point of impingement the narrow dimension of the fluid jet being contoured progressively from the center thereof outwardly toward each end. Preferably the narrow dimension of the jet is greater at each end than at the center thereof, whereby the coating weight is greater at the center of the strip than at the edges, and heavy edge coatings and oxide "berries" are eliminated.

The above summary of the prior art indicates that numerous suggestions have been offered as to how satisfactory performance might be achieved with a jet finishing system. Numerous variations in nozzle construction and methods of operation have been disclosed. However, the suggested operating guidelines are of a nature which is in general too vague for design and scaling studies, and for optimum operating effectiveness. Furthermore, none of the nozzle designs or suggested operating methods has been completely successful, to the best of applicants' knowledge, in solving the principal problems of reducing ripples in the coating and edge build-up of coating metal, particularly when operating at slow line speeds (e.g., 80 to 170 feet per minute), in achieving precise control of coating thickness across the entire strip width, and a reduction of the noise level associated with fluid jet nozzles, which is greatest when directly opposed.

Moreover, in those prior art systems which utilize steam or other heated gas as the fluid jet medium, it is evident that the cost, maintenance and noise associated with steam or heated gas generation are a distinct disadvantage. The same disadvantage is inherent in the use of compressors for providing gas at elevated pressure, even if unheated.

SUMMARY

It is a principal object of the present invention to provide a method and a fluid jet nozzle structure for controlling the thickness of a liquid coating on a substrate—particularly a hot dip coating of molten metal on a ferrous strip or sheet substrate—which solves the above problems inherent in prior art apparatus and methods.

Molten coating metals which can be treated in the practice of the present invention include, but are not limited to zinc, aluminum, alloys of zinc or aluminum, and terne.

The invention provides an analytical concept which yields the following relationship between the final solidified thickness of the coating ($t$), the strip speed (U), the nozzle-to-strip separation ($Z_o$), the nozzle plenum pressure ($P_o$), and the nozzle slot or gap height ($d$):

$$t = KZ_o\left(\frac{U}{d}\right)^{\frac{1}{2}}\left[\left(\frac{P_o}{P_A}\right)^{\frac{\gamma-1}{\gamma}} - 1\right]^{-\frac{1}{2}}, \quad (1)$$

where $k$ is a constant which depends on the viscosity of the molten coating material, the efficiency of the nozzle, and the ratio of specific heats ($\gamma$) of the working fluid; and $P_a$ is the atmospheric pressure.

The analytical concept also provides a prediction as to the particular motion of the molten coating in the vicinity of the jet interaction, and a theoretical explanation of the cause of ripple formation, as well as recommended procedures for its elimination.

In addition, the analytical description indicates that the capacity of a given flow stream for reducing the thickness of the molten coating material by impacting on the coating suface is proportional to the maximum in the gradient of a resultant "stagnation pressure profile" (as hereinafter defined) on that side of the profile which is facing the oncoming strip. The analytical concept further provides an explanation of the particular nature of the flow in the fluid jet and a recommendation as to where the strip should pass within the jet flow field in order to encounter the largest lateral gradient in free jet momentum flux and therefore the largest gradient in the stagnation pressure profile in the resultant flow stream-strip interaction. Tests have demonstrated that for any given nozzle structure there is a region adjacent the nozzle orifice (hereinafter referred to as the "near-field region") where the free jet flow is not as effective as the flow in other portions of the jet for finishing the molten metal coating, due to the initial interaction between the flow stream and the stationary ambient atmosphere. Most effective jet finishing can be achieved when using a nozzle which yields a near-field region of minimum extent. Such a minimum near-field will extend "downstream" for a distance of about 8 to 10$d$ from the nozzle exit, where $d$ is the height of the nozzle slot.

Accordingly, the invention provides a nozzle for use in the finishing of a molten metallic coating on a moving metallic strip adapted to generate a subsonic flow stream having a high lateral momentum flux (as hereinafter defined), the nozzle having an internal and external configuration such that the near-field region is 8 to 10 times the narrow dimension of the orifice, i.e., the nozzle slot or gap height. Means are provided to adjust the orifice size and to contour or vary the narrow dimension thereof from the center outwardly toward each edge, in known manner. Preferably the narrow dimension of the orifice is greater adjacent the strip edge than in the center thereof, and the narrow dimension adjacent the strip edge is adjusted to satisfy the relation $Z_o = \phi\, d$, where $\phi > 8$ to 10.

According to the invention there is provided a method of finishing a molten metallic coating on a moving metallic strip, comprising the steps of passing said strip through a bath of molten coating metal, withdrawing it therefrom in a generally vertical path of travel, positioning an elongated nozzle at a predetermined distance from the strip surface and at a height above the coating material bath surface where the thickness of the molten coating is in excess of the desired final coating thickness, said nozzle having a length at least equal to the strip width, supplying a fluid to said nozzle at a pressure such that an elongated jet of fluid at subsonic velocity issues from an orifice in said nozzle and impinges on the coated strip, maintaining the strip flat in the plane of impingement of said jet thereon, the narrow dimension of said jet being increased progressively from the center toward each end thereof by contouring the narrow dimension of said orifice, adjusting the distance from said orifice to said strip, relative to the narrow dimension of said orifice adjacent the strip edge in such manner that $Z_o > \phi\, d$ where $Z_0$ = distance from orifice to strip $\phi$ = length of near-field region, expressed as a multiple of $d$, $d$ = narrow dimension of orifice at strip edge, and further adjusting the strip speed and the pressure of said fluid supplied to said nozzle in accordance with Equation (1) hereinabove, whereby to control coating thickness and to minimize ripples in and edge build-up of said coating metal.

The method of the invention is broadly applicable to and achieves optimum effectiveness in, any jet finishing operation wherein two-dimensional subsonic turbulent flow from a nozzle is used. When used in conjunction with the nozzle of the present invention the factor $\phi$ equals 8 to 10.

BRIEF DESCRIPTION OF THE DRAWINGS

Reference is made to the accompanying drawings wherein:

FIG. 5 is a schematic representation of the near-field and far-field regions and velocity in a two-dimensional turbulent free jet;

FIG. 12 is a diagrammatic representation of the principal components of a molten metal coating the line embodying the present process.

DESCRIPTION OF THE PREFERRED EMBODIMENTS

Figure 1:
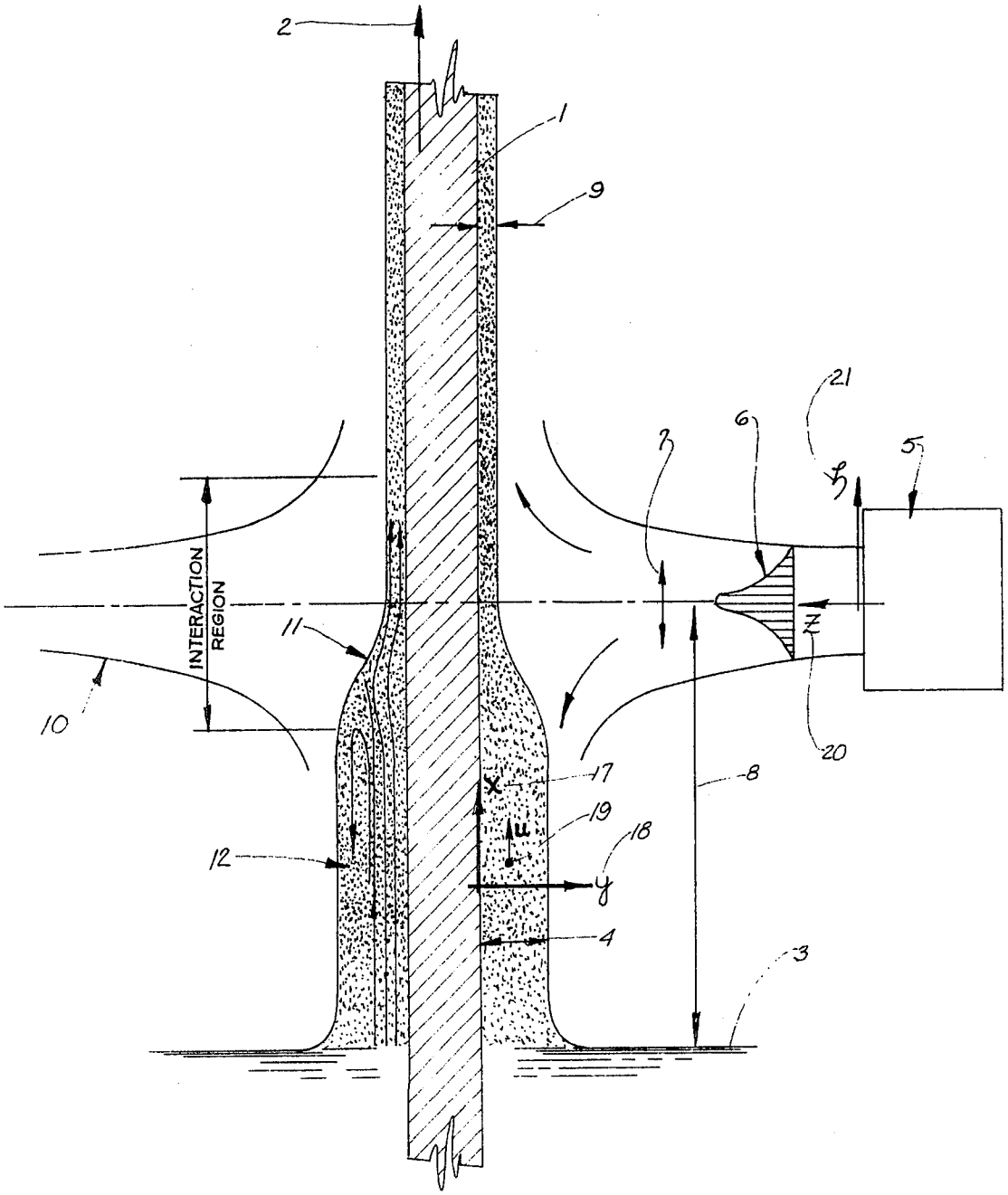
FIG. 1 is a schematic representation of a jet finishing process showing the co-ordinate system used in the analytical representation.

Referring to FIG. 1 of the drawings, a metal strip 1 is passed through and withdrawn in a generally vertical direction 2 from a bath of molten coating material 3, with the consequence that molten coating material 4 is carried from the bath on the strip surface. A nozzle 5 capable of producing a jet flow 6 with a large momentum gradient in the lateral direction 7 is located on each side of the strip at a height 8 above the coating bath, where the coating material is molten and where its thickness is in excess of the desired final solidified coating thickness 9. The flow 10 from the nozzles 5 impinges on the molten layer of coating material 4 which is carried from the bath by the strip and causes effectively a "jet dam" 11 to form, this dam effectively metering the quantity of coating material that is allowed to remain on the strip and form the final solidified coating thickness 9, the excess molten coating material 12 being caused to flow back into the bath 3.

Coating material is carried upwardly from the bath on the strip surface by reason of the viscous interaction between the coating material and the strip surface. Since the magnitude of the viscous force is proportional to the velocity gradient within the layer of molten coating material, the thickness of the resultant coating layer increases with the strip speed. Accordingly, the achievement of coating weights specified by industry requires that the coating thickness be metered and that the excess coating material be returned to the molten bath. This can be done, as illustrated in FIG. 1, by causing an elongated (two-dimensional) flow of gas 10 to impinge on the surface of the molten coating material in such a way as to form a "stagnation pressure dam", which extends across the strip width and effectively controls the coating thickness, thereby causing the excess coating material 12 to flow back into the bath.

It will be appreciated that this "jet finishing" method of coating weight control involves numerous operating parameters and that the achievement of optimum operating conditions for a range of strip speeds, coating thicknesses, coating materials, and jet finishing gases is a formidable task.

Figure 2:
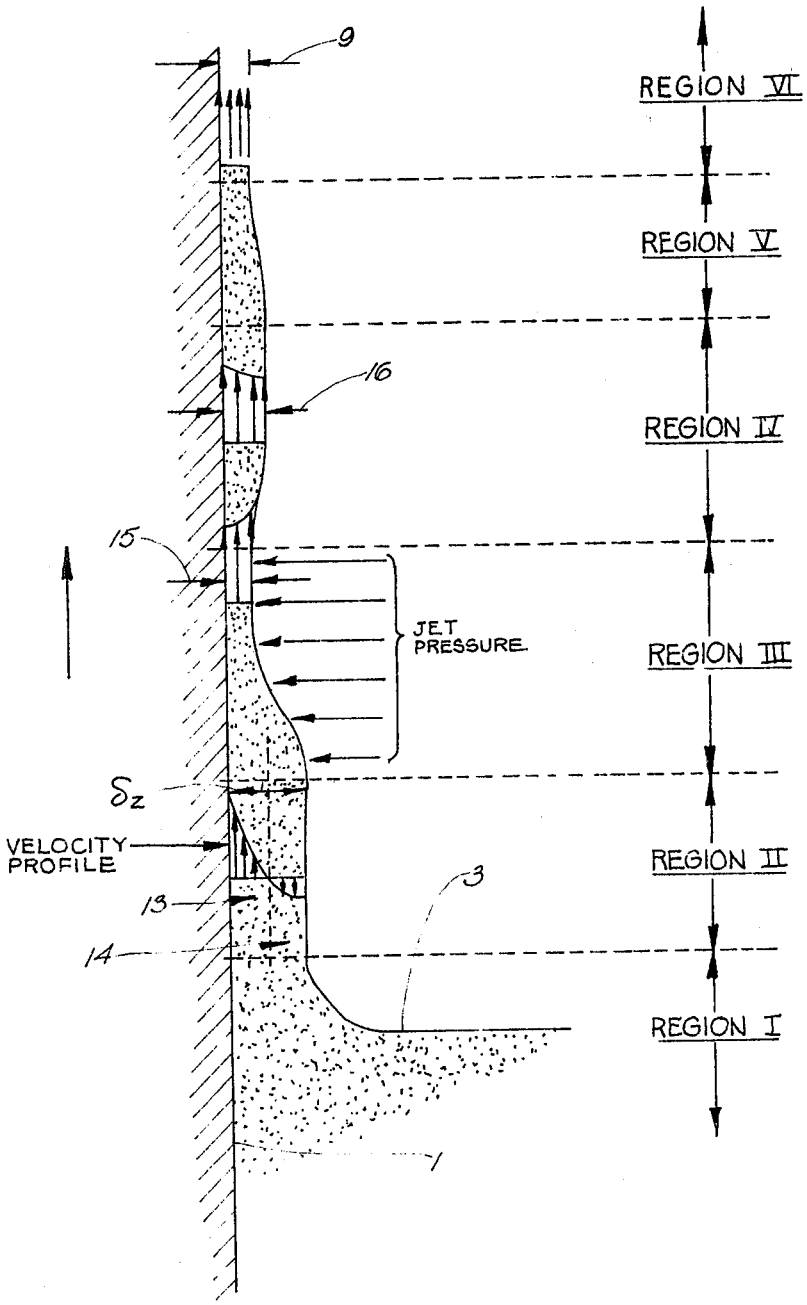
FIG. 2 is a diagrammatic representation of various flow regions into which the coating fluid motion on the strip can be divided.

The viscous fluid flow within the molten coating layer can be divided into six regions as shown in FIG. 2, these being as follows:

Region I is a transition region where the fluid flow that is entrained by the strip motion within the bath is transformed into that flow which can be supported by the viscous shear forces at the strip surface.

Region II extends from Region I to the region of the jet interaction. The fluid motion in Region II consists of a counterflow with an up-flow (carried by the strip) in the region 13 adjacent the strip surface, and a down-flow (turned around by the jet interaction) at 14 on the outer surface. It will be recognized that the vorticity associated with the counterflow may cause the outer down-flow to break into streaks and droplets.

Region III is the region of the jet finishing interaction. The stagnation pressure profile associated with the jet interaction causes an associated pressure variation to occur within the molten coating fluid. This pressure variation causes a pressure-induced flow which must be superimposed on the viscosity-induced flow caused by the moving strip. At the loading edge of the jet interaction the pressure-induced flow opposes the velocity-induced flow. Therefore the total flow field behaves as if a pressure dam were metering the quantity of liquid coating which can be carried by the strip. In the trailing portion of the jet interaction the pressure-induced flow adds to the velocity-induced flow. This flow distorts the overall velocity profile into the form shown at 15 and causes an additional slight depression in the coating thickness.

Region IV is a region just beyond the jet interaction region where the pressure-distorted velocity profile shown at 15 relaxes under the action of viscous forces to the form shown at 16. After equilibration the velocity profiles are determined by a balance between viscous shear forces and gravity forces, as are the profiles in Region II.

In Region V the coating material cools and the viscosity increases, thereby causing the velocity profile to evolve into the uniform solidified form shown in Region VI.

The co-ordinate systems shown in FIG. 1 are used to facilitate an analytical description of the jet finishing process.

The $x$-direction, shown at 17, is taken as the vertical direction of travel 2 of the strip. The $y$-direction, shown at 18, is taken as the direction of coating thickness perpendicular to the strip surface. The term $u$ is used to denote the flow velocity in the molten coating layer at a particular point 19 in the $x$-$y$ co-ordinate system, i.e., the molten fluid velocity seen by an observer standing in the frame of reference of the molten bath and watching the motion of the passing strip.

The Z-direction, shown at 20 in FIG. 1, is taken as the axial direction of flow with respect to the two-dimensional nozzle 7. The $\zeta$-direction, shown at 21, is taken as the direction perpendicular to $z$ and is the lateral direction of fluid flow from the nozzle. The term W is used to denote the flow velocity in the free jet at a particular point 22 in the $Z - \zeta$ co-ordinate system, i.e., the jet flow velocity seen by an observer standing in the frame of reference of the nozzle.

In particular, the following terms are used in providing an analytical description of the jet finishing process:

- $d$ = slot opening of two-dimensional nozzle (narrow dimension)
- $g$ = acceleration of gravity
- K = constant which depends on the viscosity of the molten coating material, the efficiency of the nozzle, the ratio of specific heats of the working fluid, and atmospheric pressure
- P = total force per unit length delivered by the stagnating nozzle flow to the strip surface
- $p$ = pressure
- $p_o$ = gas pressure in the nozzle plenum
- $P_A$ = ambient (atmospheric) pressure
- Q = volumetric flow of coating fluid per unit width on strip surface as seen in laboratory co-ordinate system
- $Q_o$ = volumetric flow corresponding to final solidified coating thickness.
- $t$ = solidified coating thickness
- U = strip speed
- $u$ = coating fluid velocity in direction parallel to the strip surface in laboratory co-ordinate system
- W = gas velocity within jet flow
- $W_o$ = gas velocity at nozzle exit
- $x$ = vertical co-ordinate (direction of strip motion)
- $y$ = horizontal co-ordinate (perpendicular to strip surface)
- Z = co-ordinate aligned with jet axis
- $Z_o$ = nozzle-to-strip separation
- $\alpha$ = effective viscosity/reference viscosity
- $\beta$ = scaling constant relating to jet stagnation on strip surface
- $\zeta$ = co-ordinate perpendicular to jet axis and nozzle slot
- $\delta$ = thickness of molten coating
- $\mu_o$ = reference viscosity
- $\eta$ = nozzle efficiency
- $\rho$ = mass density of molten coating material
- $\rho_f$ = mass density of finishing fluid
- $\sigma$ = constant relating to scale of turbulence in jet flow
- $\phi$ = length of near-field region, expressed as a multiple of slot opening $d$ The flow of the molten coating can be described by the two-dimensional equations of incompressible, constant viscosity, creep flow as simplified by the methods of boundary layer analysis, reference being made to H. Schlicting, *Boundary Layer Theory,* Fourth ed., McGraw-Hill, New York (1960). This approach is justified by the relatively thin nature of the coating layers (generally less than a few mils) and the relatively low flow velocity (the flow velocities will of course not exceed the strip speeds which are generally in the range of 50 to 500 fpm).

In addition, it can be assumed that there is no slip at the fluid-strip interface and that the effect of surface roughness can be included as an effective viscosity. The effects of surface tension and oxidation can be neglected in developing an analytical description that is adequate for engineering and mill considerations.

Thus the motion of the fluid coating on the strip is governed by the following two equations, written in terms of the co-ordinate system shown in FIG. 1:

$$\alpha_o \mu \frac{\delta^2 u}{\delta y^2} = \rho g + \frac{dp}{dx} \tag{2}$$

and $$Q_o = Ut = \int_{y=o}^{y=2} u(x,y)dy . \tag{3}$$

Equation (2) is the equation of motion, and states that the resultant fluid motion is the consequence of a balance between the viscous shear forces (contained in the term on the left), the gravitational force (first term on the right), and the pressure gradient (second term on the right) which is induced in the coating fluid by external forces such as the stagnation of the finishing jet flow on the coating surface. Equation (3) is the conservation of mass and states that the net upward flux of coating material on the strip surface at all points above the coating bath must be equal to the flux contained in the final solidified coating.

The coating flow in the regions away from the influence of the impacting jet stream (Region II and equilibrated portion of Region IV in FIG. 2) is determined by solving Equations (2) and (3) with the $dp/dx$ term in Equation (2) set equal to zero. Equation (2) is a second order differential equation in terms of the coating flow velocity. Therefore its solution requires that two conditions (boundary conditions) concerning the coating velocity be specified. The appropriate conditions are that the coating velocity at the strip surface be equal to the strip velocity, and that the laterial gradient in coating velocity $\alpha u/\alpha y$ be equal to zero at the free surface. The first specification is a consequence of the requirement that there be no slip at the strip-coating interface. The second specification is a consequence of the requirement that there be no forces (surface tension or oxide layers) acting on the free surface. Accordingly, the general solution to Equation (2) written in terms of the coating thickness $\delta$ in the region in question is:

$$u = U - \left(\frac{\rho g \delta}{\alpha \mu_o}\right) y + \left(\frac{\rho g}{2\alpha \mu_o}\right) y^2. \tag{4}$$

The continuity Equation (3) provides a relationship between the permissible values of $\delta$ and the final solidified coating thickness $t$. Thus substituting Equation (4) into Equation (3) and performing the integration yields $$t = \delta - \left(\frac{\rho g}{3\alpha \mu_o}\right) \frac{\delta^3}{U}. \tag{5}$$

Figure 3:
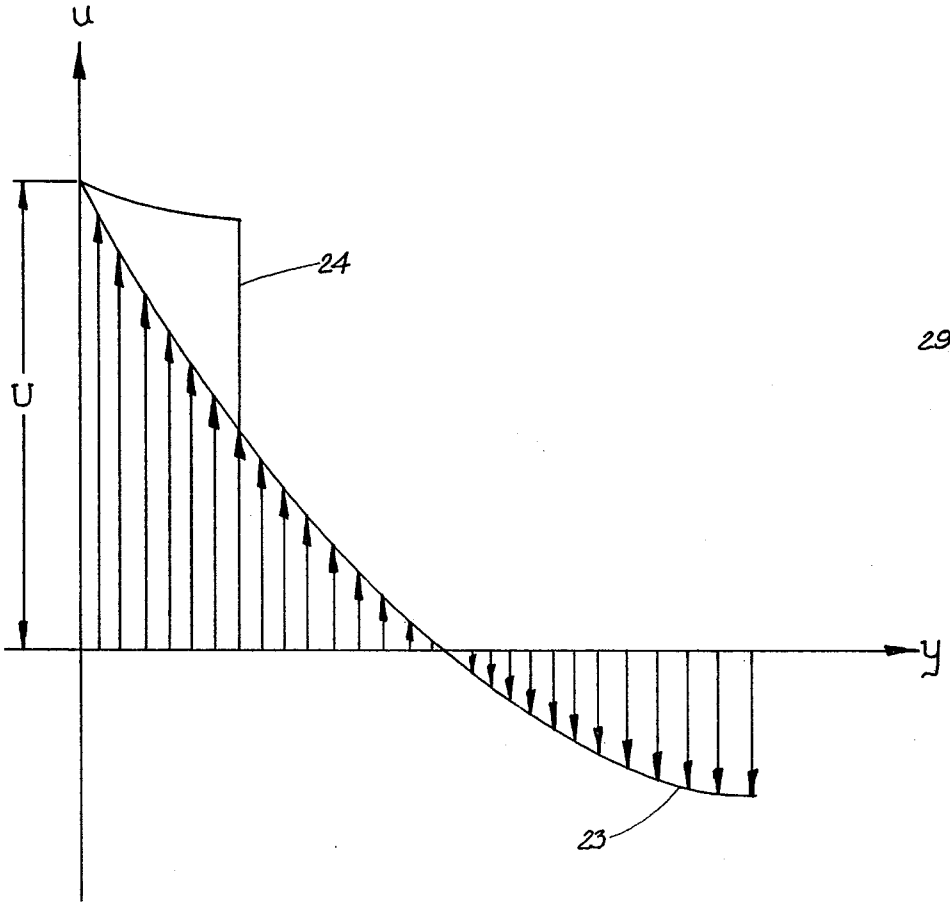
FIG. 3 is a schematic representation of typical velocity profiles within the molten coating layer.

FIG. 3 shows typical velocity profiles that are compatible with Equations (4) and (5). Profile 23 is of the type which is applicable to Region II and shows the down-flow on the outer surface. Profile 24 is of the type which is applicable to the equilibrated portion of Region IV.

The coating flow in the jet finishing interaction region (Region III) is determined by solving Equation (2) with the $dp/dx$ term included. Since the coating thickness is small compared to the length of the interaction region, the finishing jet can be assumed to impact on an essentially flat molten surface. Furthermore, since the viscosity of the jet finishing fluid is much less than that of the molten coating material, the impacting jet exerts essentially only a normal force on the coating surface. Thus the appropriate boundary conditions for solving Equation (2) in Region III are identical to those used outside the interaction region (i.e., in Region II). Accordingly, it is stipulated that the coating velocity at the strip surface in Region III is equal to the strip velocity (no-slip criterion) and that the gradient in coating velocity $\alpha u/\alpha y$ is zero at the free surface (a consequence of the fact that the jet flow does not exert shear forces on the free surface of the molten coating layer). At a fixed value of $x$, Equation (2) reduces to an ordinary differential equation. Accordingly, the resulting solution for the flow velocity at a given point $x$ in Region III is $$u(x) = U - \frac{\delta(x)}{\alpha \mu_o}\left(\rho g + \frac{dp}{dx}\right) y + \frac{1}{2\alpha \mu_o}\left(\rho g + \frac{dp}{dx}\right) y^2. \tag{6}$$

Figure 4:
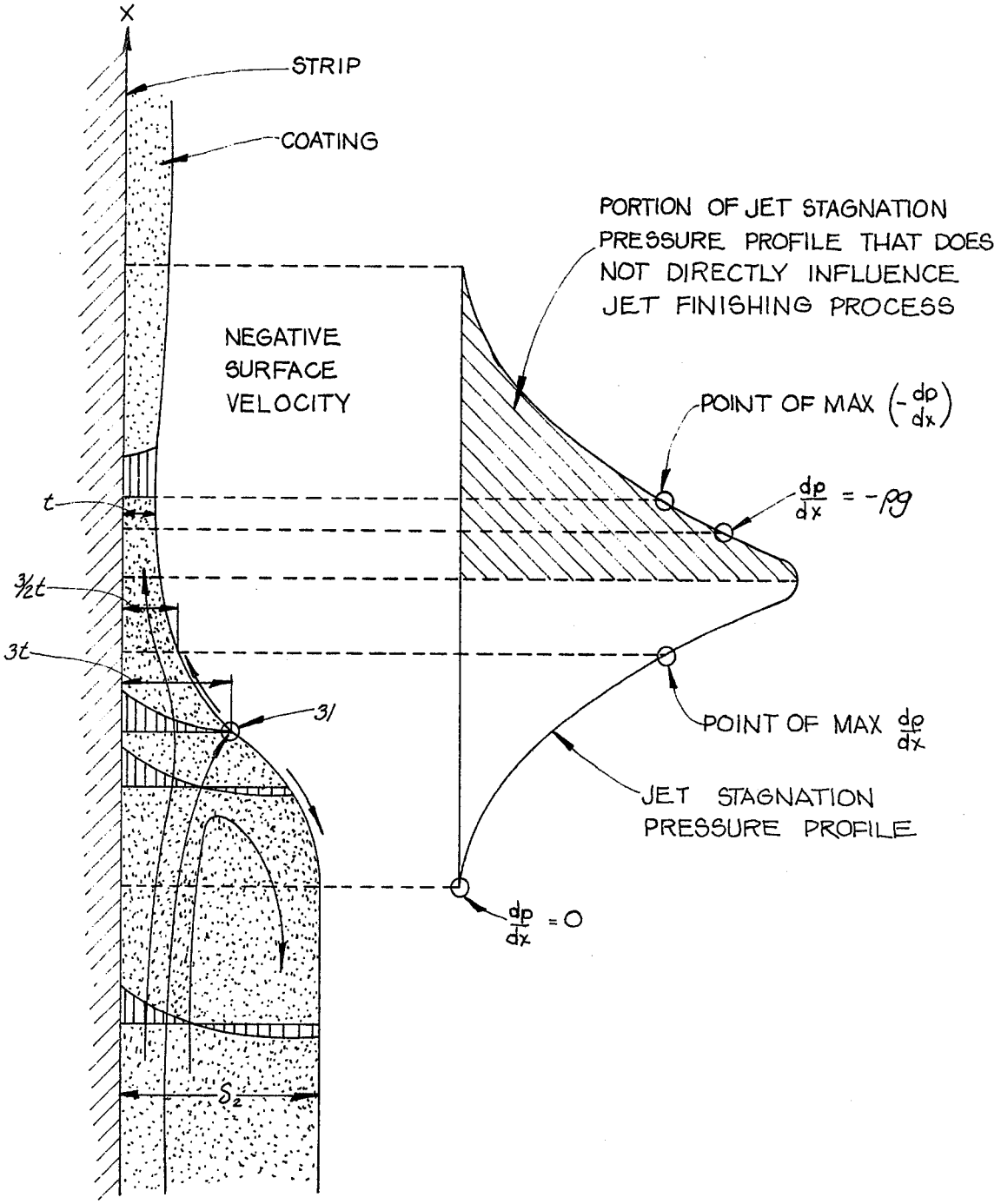
FIG. 4 is a schematic representation of the flow pattern within the molten coating in the vicinity of the interaction with the impinging jet flow.

The similarity between Equation (6) and Equation (4) is apparent. Thus the velocity profiles in the interaction region are of the same general form as those shown in FIG. 3. This is seen in FIG. 4. The effect of the finishing jet is to add the $dp/dx$ term. Since the pressure is constant across the relatively thin coating layer, the $dp/dx$ variation with the coating reflects the $dp/dx$ variation placed on the surface by the impacting jet. On the side of the stagnation pressure profile that is facing the oncoming strip, $dp/dx$ is positive and acts as an additional and variable gravity force which retards the coating flow, i.e. produces the jet finishing. On the trailing side of the stagnation pressure profile $dp/dx$ is negative and acts as a "negative gravity" which essentially squeezes or slightly accelerates the molten coating material on the strip surface.

When Equation (6) is substituted into Equation (3) and the integration is performed, the following relationship is obtained between the local pressure gradient $dp/dx$ and coating thickness $\delta(x)$, and the final solidified coating thickness $t$:

$$\frac{dp}{dx} = 3\alpha \mu_o U\left[\frac{\delta(x) - t}{\delta^3(x)}\right] - \rho g. \tag{7}$$

Equation (7) shows that the coating thickness profile in the interaction region $\delta(x)$ is related in a rather complex way to the stagnation pressure profile $p(x)$ produced by the incident jet. However, if Equation (7) is differentiated twice with respect to $\delta(x)$, and if the second differential is set equal to zero, it is found that the maximum of the first derivative of the stagnation pressure obeys the relation:

$$\left(\frac{dp}{dx}\right)_{MAX} = \frac{4}{9}\alpha \mu_o \frac{U}{t^2} - \rho g. \tag{8}$$

Equation (8) shows that the final solidified coating thickness $t$ depends only on the maximum gradient in the stagnation pressure profile on the side of the profile which is facing the oncoming strip. The flow is shown schematically in FIG. 4.

The analytical description of the jet finishing process is completed by expressing the stagnation pressure profile which is developed by the impinging jet flow in terms of those operating parameters that can conveniently be used to control commercial-scale jet finishing systems.

It has been found that two-dimensional subsonic free jets operating with air and superheated steam at nozzle plenum chamber pressures of 1 to 10 psig are particularly effective in jet finishing. Although such flows may be laminar within the nozzle, they become turbulent almost immediately in the free jet expansion. The resultant free jet flow is shown schematically in FIG. 5. The flow field can be divided into two general regions: (1) a near-field region which is characterized by the initial interaction between the flow stream and the stationary ambient gas, and which therefore is sensitive to the nozzle configuration and operating conditions; and (2) a far-field region, where the flow is dominated by a single physical process, i.e., the viscous and turbulent interaction between the jet flow and the stationary ambient gas, and where the qualitative nature of the flow is insensitive to specifics of the nozzle configuration (provided that the nozzle is designed to deliver a two-dimensional parallel flow). Preferably the near-field extends downstream from the jet exit for a distance of about 8 to 10 $d$, where $d$ is the slot opening of the two-dimensional nozzle. At the nozzle end of the near-field region the flow consists of a potential core, 25, which extends downstream about $5d$, surrounded by mixing zone 26. The velocity in the potential core is approximately equal to the velocity at the nozzle exit. Beyond the termination of the potential core, there exists a transitional mixing region 27 where the velocity profiles transform into the equilibrium and mathematically similar form 28 characteristic of the far-field region.

It has been determined experimentally (J. H. Perry, *Chemical Engineers' Handbook*, McGraw-Hill, New York (1968) pages 5–18) that the centerline velocity beyond the termination of the potential core of two-dimensional turbulent jets of the type described above, obeys an equation of the form $$W_{\zeta_c}(Z) = (2.28)\, W_o (d/Z)^{1/2}. \tag{9}$$

In addition it has been derived analytically, and confirmed experimentally according to the above Schlicting book, that the mathematically similar velocity profiles in the far-field region obey an expression of the form $$W(\zeta,Z) = W_{\zeta_c}(Z)\, \mathrm{Sech}^2(\sigma(\zeta/Z)). \tag{10}$$

An expression for the flow velocity throughout the far-field region of the jet is obtained by combining Equations (9) and (10), $$W(\zeta,Z) = (2.28)\, W_o (d/Z)^{1/2}\, \mathrm{Sech}^2(\sigma(\zeta/Z)). \tag{11}$$

Figure 6:
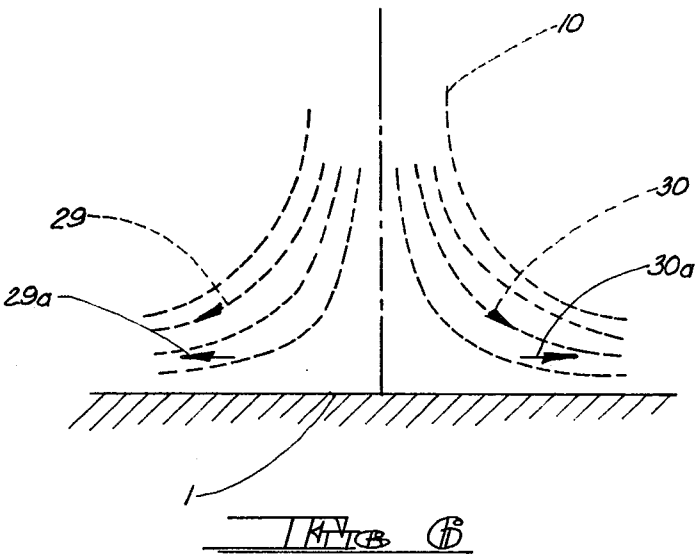
FIG. 6 is a schematic representation of the flow within a free jet impinging on a flat surface.

When the jet flow stagnates on the strip surface, the flow breaks up into two sub-flows (29 and 30) parallel to the strip surface as shown in FIG. 6. The total force exerted by the flow stream on the coating surface is equal to the time rate of change of momentum as the flow undergoes the stagnation process. For a jet flow directed normally to the strip surface, the momentum in the direction of the incident flow is clearly zero after the interaction with the surface. Therefore the total force per unit width delivered to the coating surface is simply equal to the total momentum flux per unit width in the free jet, which, because of momentum conservation, must be equal to the jet momentum flux per unit width at the nozzle exit. This total force is also equal to the integral of the stagnation pressure profile on the strip surface. Therefore there is obtained the condition:

$$P = \int_{x=-\alpha}^{x=+\alpha} p(x)dx = \rho_f \int_{\zeta=-\alpha}^{\zeta=+\alpha} W^2(\zeta Z)d\zeta = \rho_f W_o^2 d. \tag{12}$$

The degree of jet finishing is determined by the maximum gradient $(dp/dx)_{max}$ in the stagnation pressure profile (see Equation (8)) rather than simply the total force P exerted by the jet on the coating surface. Therefore an expression is required for the stagnation pressure profile $p(x)$.

Figure 7:
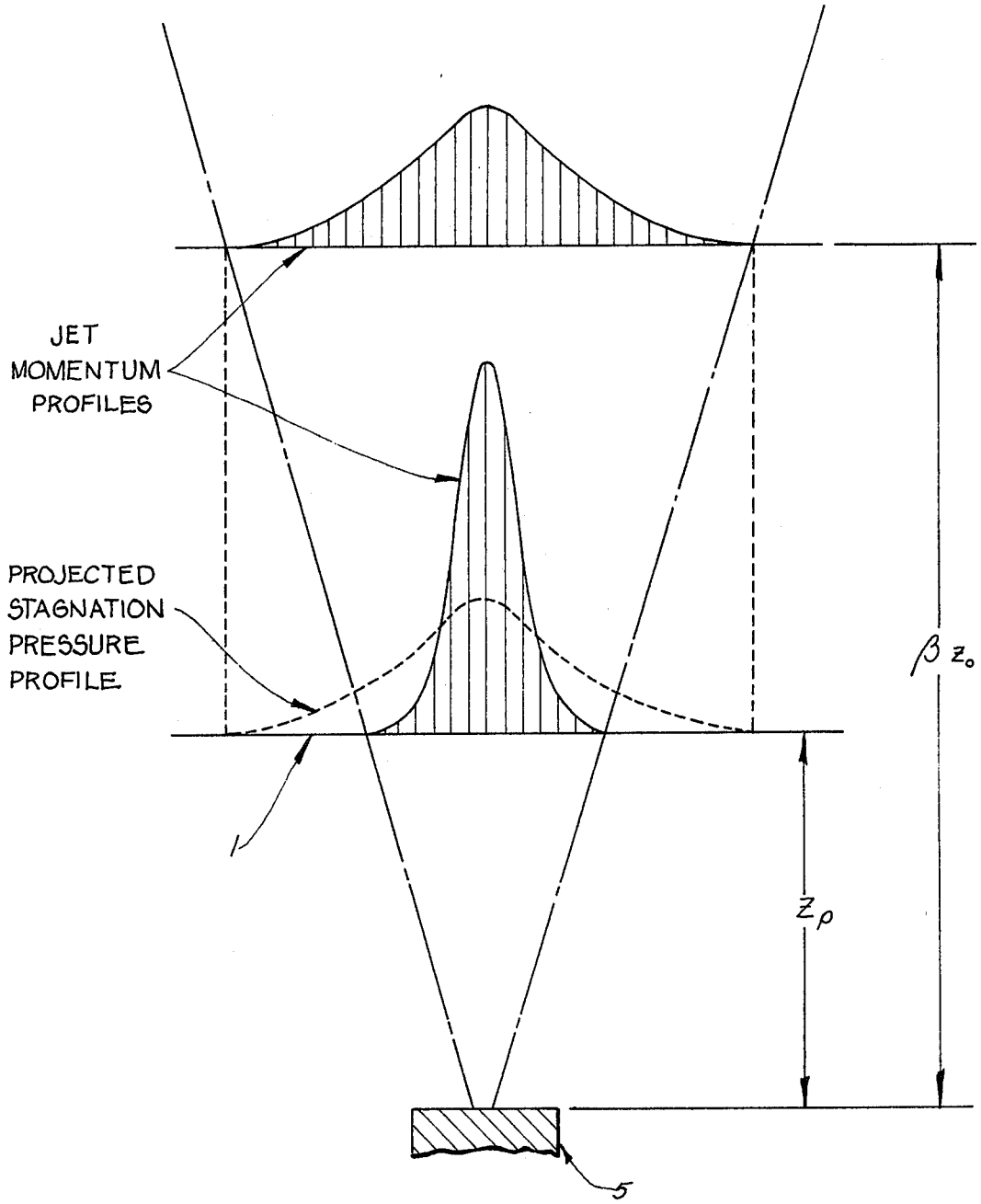
FIG. 7 is a schematic representation of the definition of the parameter $\beta$.

Although the integrated stagnation pressure profile is equal to the integrated momentum flux (Equation (12)), the flow along the coating surface (29*a* and 30*a* in FIG. 6) causes the stagnation pressure profile at a given nozzle-to-strip separation $Z_o$, to be more spread out than the corresponding momentum profile in the flow stream at the point of incidence with the strip. In particular, for the case of a jet flow that is directed perpendicularly to the strip surface, the stagnation pressure profile that forms on a surface situated at a distance $Z_o$ from the nozzle exit will be equal to the momentum profile that would exist if the free jet were allowed to flow to a distance $\beta Z_o$ from the nozzle exit and therefore to become more spread out because of its interaction with the stationary atmosphere. The relationship is shown schematically in FIG. 7 (Physically the interaction of the free jet with the ambient atmosphere causes a momentum transport in the $\zeta$-direction, and a spreading of the momentum profile, that is similar in effect to the $x$-directed flow that occurs if the jet is caused to impact on a perpendicular surface.)

It has been shown experimentally that the stagnation pressure profile that develops on a flat surface is insensitive to the angular orientation of the centerplane of the jet with respect to the normal to the surface for angular variations of less than 10°. Therefore in developing an analytical description for the jet finishing process, the impinging jet flow is taken to be directed normally to the strip surface.

The momentum flux in the free jet flow at a distance $Z$ from the nozzle exit can be calculated from Equation (11), $$\rho W^2 = (5.2)\rho_f W_o^2 d/Z\, \mathrm{Sech}^2(\sigma\zeta/Z). \tag{13}$$

An expression for the stagnation pressure profile which develops on a surface situated at distance $Z_o$ from the nozzle exit, is obtained by substituting $Z = \beta Z_o$ into Equation (13). The resulting expression for the stagnation pressure profile is then $$\rho(\zeta) = (5,2)\rho_f W_o^2 \frac{d}{\beta Z_o}\, \mathrm{Sech}^2\left(\sigma \frac{\zeta}{\beta Z_o}\right), \tag{14}$$

where it is noted that $\zeta$ is an $x$-coordinate with its origin at the jet axis. Differentiating Equation (14) twice with respect to $\zeta$, and setting the second derivative equal to zero, provide the following expression for the maximum gradient in the stagnation pressure profile:

$$\left(\frac{d\rho}{d\zeta}\right)_{MAX} = (45.7)\rho_f W_o^2 \frac{d}{\beta^2 Z_o^2}. \tag{15}$$

Since $d\zeta = dx$, Equation (15) may be substituted into Equation (8) to obtain a relationship between the final solidified coating thickness $t$ and the momentum flux per unit length in the finishing jet flow. At practical line speeds and coating thicknesses the gravity term $\rho g$ in Equation (8) may be neglected. Thus combining Equations (8) and (15) yields $$t = \frac{1}{10}\beta Z_o \left(\frac{\alpha \mu_o U}{P_f W_o^2 d}\right)^{\frac{1}{2}}. \tag{16}$$

In most cases the jet finishing medium can be treated as a perfect gas. For a perfect gas with a ratio of specific heats $\gamma$, the momentum flux per unit length $(\rho_f W_o^2 d)$ can be expressed in terms of the nozzle plenum pressure $\rho_o$ and the nozzle efficiency $\eta$.*

* — A. H. Shapiro — *The Dynamics and Thermodynamics of Compressible Fluid Flow*, Vol. 1, Ronald Press, New York (1953).

$$\rho_f W_o^2 d = \eta d \left(\frac{2\gamma}{\gamma - 1}\right) P_A \left[\left(\frac{P_o}{P_A}\right)^{\frac{\gamma-1}{\gamma}} - 1\right]. \quad (17)$$

The desired expression for the final solidified coating thickness as a function of the jet finishing line operating parameters is obtained by combining Equations (16) and (17).

$$t = \frac{1}{10} \beta Z_o \left[\frac{\alpha \mu_o U(\gamma - 1)}{2 \eta P_A \gamma d}\right]^{\frac{1}{2}} \left[\left(\frac{P_o}{P_A}\right)^{\frac{\gamma-1}{\gamma}} - 1\right]^{-\frac{1}{2}}. \quad (18)$$

Equation (18) may be rearranged into the form given in Equation (1), thereby obtaining the following expression for K.

$$K = \frac{1}{10} \beta \left[\frac{\alpha \mu_o (\gamma - 1)}{2 \eta P_A \gamma}\right]^{\frac{1}{2}} \quad (19)$$

It should be noted that the parameter K depends on the effective viscosity $\alpha\mu_o$ of the coating material, the ratio of specific heats $\gamma$ of the jet finishing fluid, the nozzle efficiency $\eta$, and the stagnation parameter $\beta$.

The efficiency of a properly designed nozzle of the type which will hereafter be described should approach 100% so that one can make $\eta \sim 1$.

Values of the ratio of specific heats for various gases for jet finishing are listed in the following table:

TABLE I

| Gas Species | Ratio of Specific Heats |
|---|---|
| Air | 1.40 at 17° C |
| Nitrogen | 1.40 at 15° C |
| Carbon dioxide | 1.30 at 15° C |
| Hydrogen | 1.41 at 15° C |
| Argon | 1.67 at 15° C |
| Superheated Steam | 1.30 |

The stagnation parameter $\beta$ must be equal to approximately 2, since the local stagnation pressure within the jet flow is equal to one-half the incident momentum flux, and since the total force on the strip must be equal to the total momentum flux in the incident jet (see Equation (12))—i.e., the cross-sectional area over which the stagnation pressure is above ambient must be equal to about twice the cross-sectional area of the incident jet. Laboratory tests have been conducted to investigate the stagnation pressure profiles produced by subsonic two-dimensional jets of the type which have proven to be very effective for jet finishing. The flow from such a jet is shown schematically in FIG. 5. These tests yield a value of 1.5 for $\beta$.

The effective viscosity $\alpha\mu_o$ of the coating fluid is dependent on the coating material bath temperature and is in general to be determined by experiment for a given jet finishing facility, since handbook values for the viscosities of molten metals show considerable disagreement. The viscosities of the various molten metals of interest should, in principal, be nearly identical. Therefore it has been found suitable to use a $\mu_o$ value of 0.013 gm/cm-sec or $2.715 \times 10^{-5}$ slug/ft-sec. With this value of $\mu_o$, experimentation yields $\alpha$-values of about 2. Typical handbook viscosity values which could be used for $\mu_o$ are listed in Table II, the source being C. J. Smithells, *Metals Research Book,* Volume III, Plenum Press, London (1967), pages 688–690.

A typical value of K calculated from Equation (19) for $\alpha = 2$, $\mu_o = 2.72 \times 10^{-5}$ slug/ft-sec, $\gamma = 1.4$, $\eta = 1.0$, $\beta = 1.5$ and $\rho_A = 2117$ lb/ft$^2$ (14.7 psi) is $9.1 \times 10^{-6}$ sec$^{\frac{1}{2}}$.

As mentioned previously, K will be constant for a particular coating facility which is being used with a given coating material at a given bath temperature and with a given jet finishing fluid accelerated by a particular set of nozzles. Thus, once K is determined for such a facility, Equation (1) can be used to provide a mathematical determination of the influence of operating parameters such as the nozzle-to-strip separation $Z_o$, strip speed U, nozzle slot gap $d$, and plenum pressure $\rho_o$ on the resultant coating thickness. Typical K-values for a number of coating facilities are given in Table III.

TABLE II

| Coating Material | Temp. (° C) | Viscosity (gm/cm-sec) | Viscosity (slug/ft-sec) |
|---|---|---|---|
| Aluminum | 660 | 0.045 | $9.39 \times 10^{-5}$ |
| | 700 | 0.029 | $6.06 \times 10^{-5}$ |
| Lead | 400 | 0.023 | $4.80 \times 10^{-5}$ |
| | 500 | 0.019 | $3.97 \times 10^{-5}$ |
| Tin | 300 | 0.017 | $3.55 \times 10^{-5}$ |
| | 400 | 0.014 | $2.92 \times 10^{-5}$ |
| Zinc | 500 | 0.037 | $7.72 \times 10^{-5}$ |
| | 600 | 0.033 | $6.89 \times 10^{-5}$ |

In Equation (1) the coating thickness is proportional to the nozzle-to-strip separation, the square root of the strip speed, the inverse square root of the nozzle slot opening, and approximately the inverse square root of the nozzle plenum pressure ratio.

TABLE III

| Facility | Coating Material | Jet Finishing Fluid | Nozzle-to-strip Separation (inches) | Strip Speed (fpm) | Nozzle Plenum Pressure (psig) | Avg. Nozzle slot (inches) | K-Valve (sec'-) |
|---|---|---|---|---|---|---|---|
| A | Zinc | Air | ¼ - 1 | 40 - 70 | 0.9 - 3 | 0.032 | $10.1 \times 10^{-6}$ |
| B | Zinc | Superheated Steam | ¼ - 1 | 40 - 70 | 0.9 - 1.85 | 0.032 | $11.1 \times 10^{-6}$ |
| C | Zinc | Superheated Steam | ¾ - 1 | 90 - 250 | 1.4 - 3.9 | 0.11 | $4.4 \times 10^{-6}$ |
| D | Zinc | Air | ¾ - 2½ | 100 - 180 | 0.6 - 1.58 | 0.098 | $4.2 \times 10^{-6}$ |
| E | Zinc | Superheated Steam | ½ - 1 | 280 - 300 | 1.6 - 3.6 | 0.11 | $9.1 \times 10^{-6}$ |
| F | Zinc | Air | ½ - 2 | 100 - 182 | 0.5 - 2.0 | 0.05 | $4.5 \times 10^{-6}$ |
| G | Aluminum* | Air | ¾ - 1¼ | 345 - 360 | 0.9 - 1.0 | 0.095 | $10 \times 10^{-6}$ |
| H | Aluminum* | Air | ¼ - 1 | 40 - 70 | 0.9 - 3.0 | 0.032 | $7.6 \times 10^{-6}$ |
| I | Aluminum | Air | ¼ - 1 | 60 - 110 | 0.9 - 3.0 | 0.032 | $16.1 \times 10^{-6}$ |
| J | Terne | Air | ½ - ¾ | 60 - 110 | 1.2 - 2.7 | 0.025 | $5.1 \times 10^{-6}$ |

*Aluminum alloyed with 9%-by-weight silicon

Figure 9:
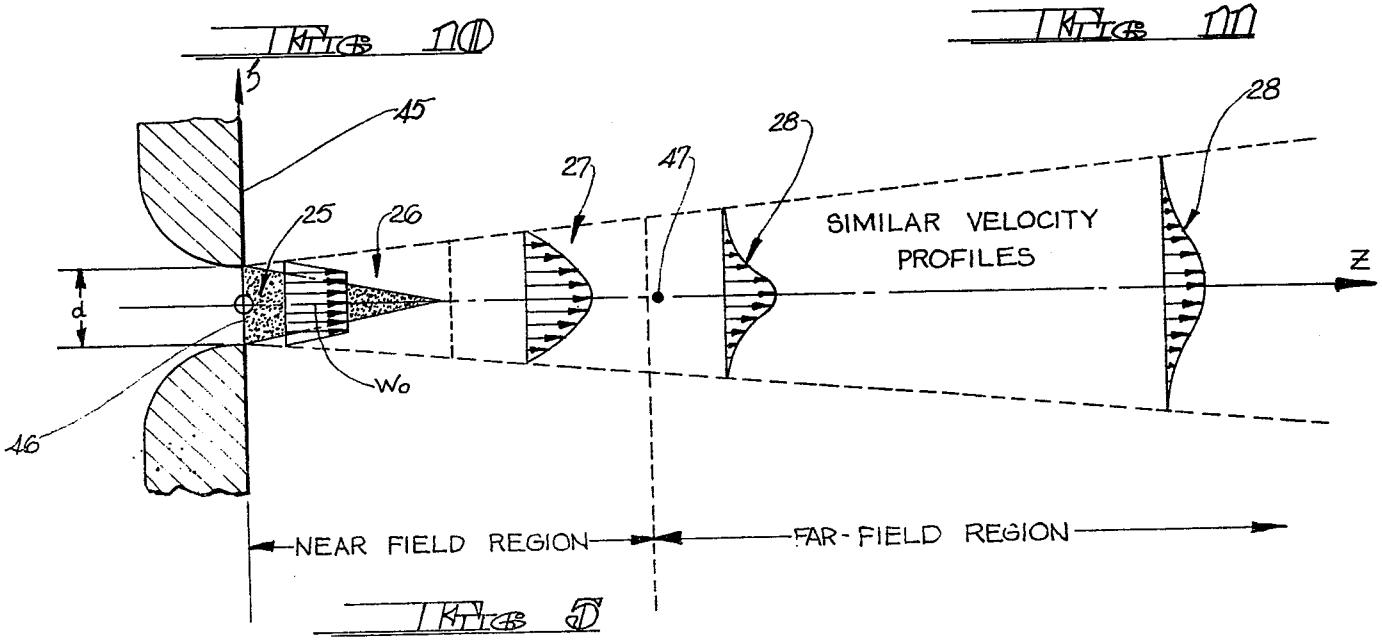
FIG. 9 is a performance plot relating coating weight to nozzle plenum pressure ration term.
Figure 8:
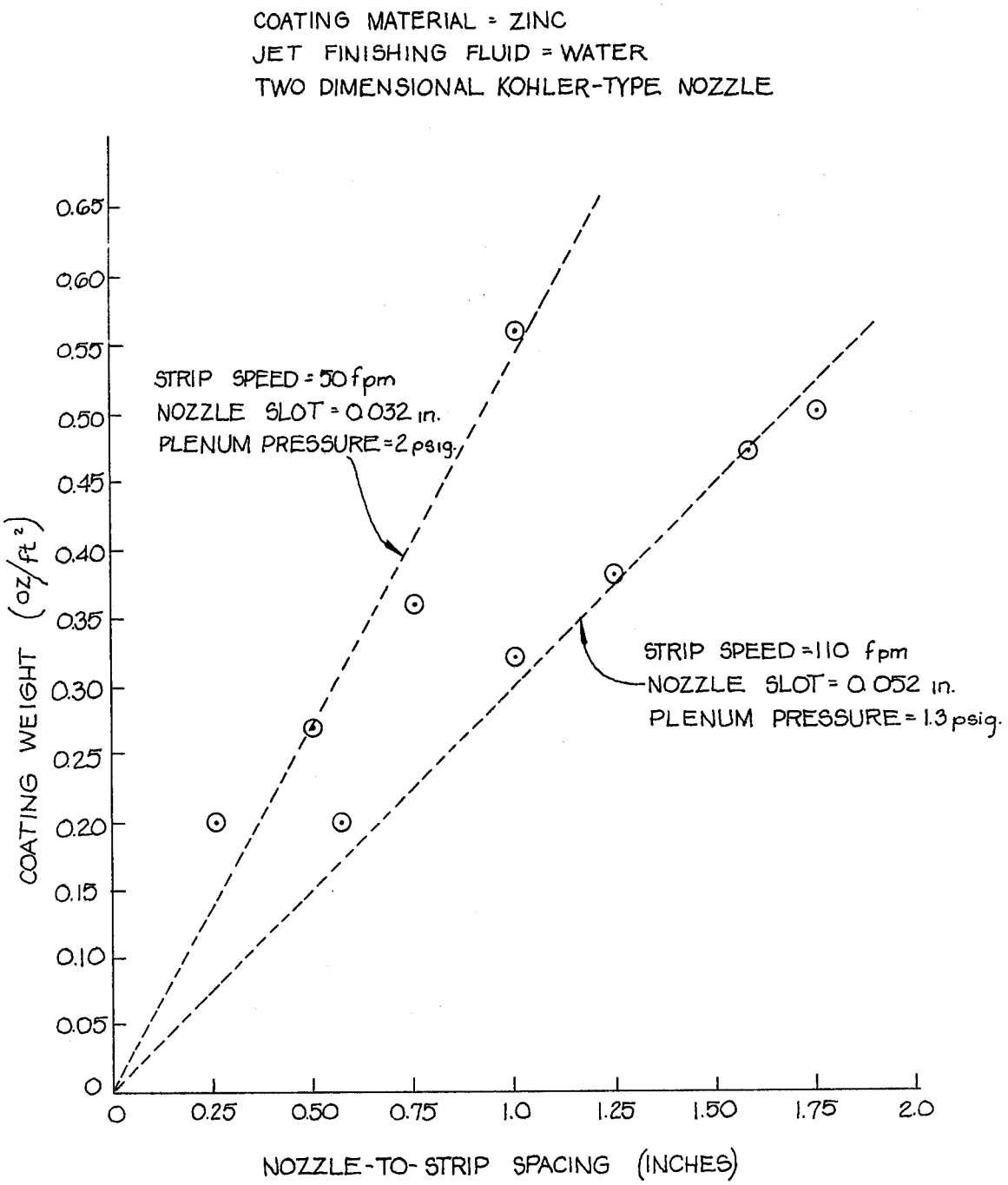
FIG. 8 is a performance plot relating coating weight to nozzle-to-strip spacing.
Figure 8D:
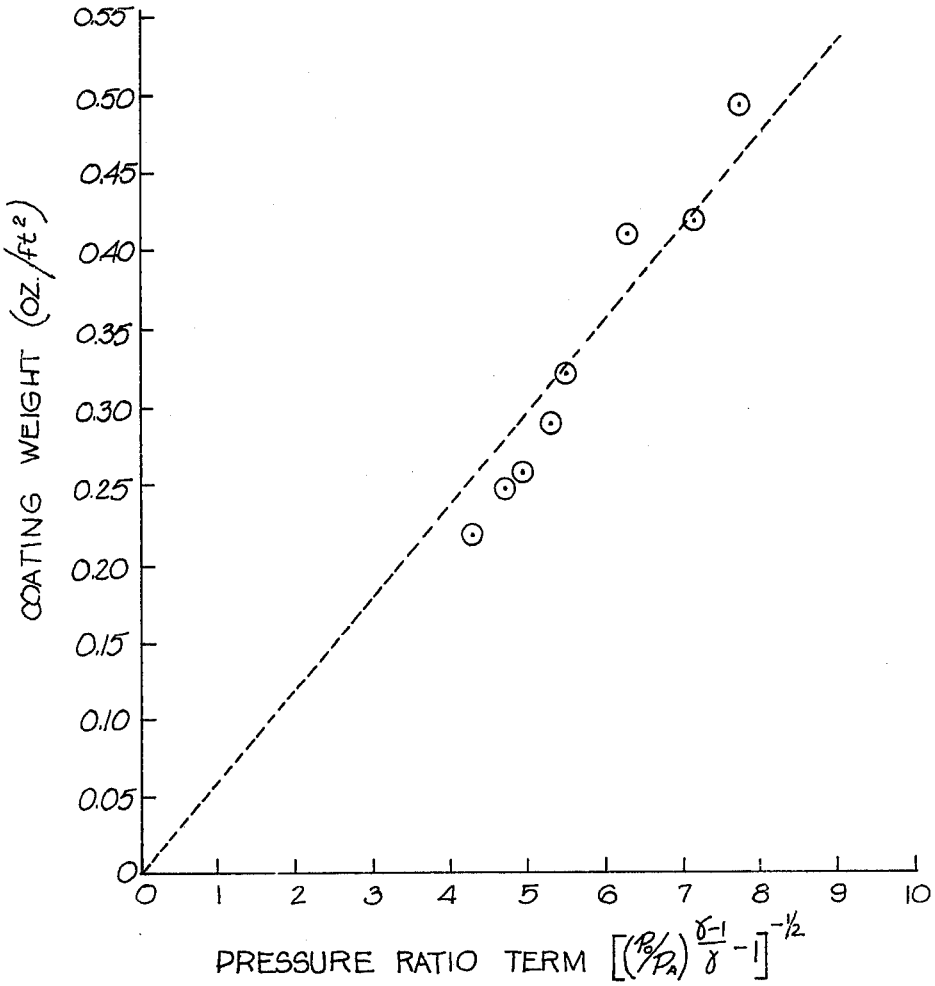
Figure 19:
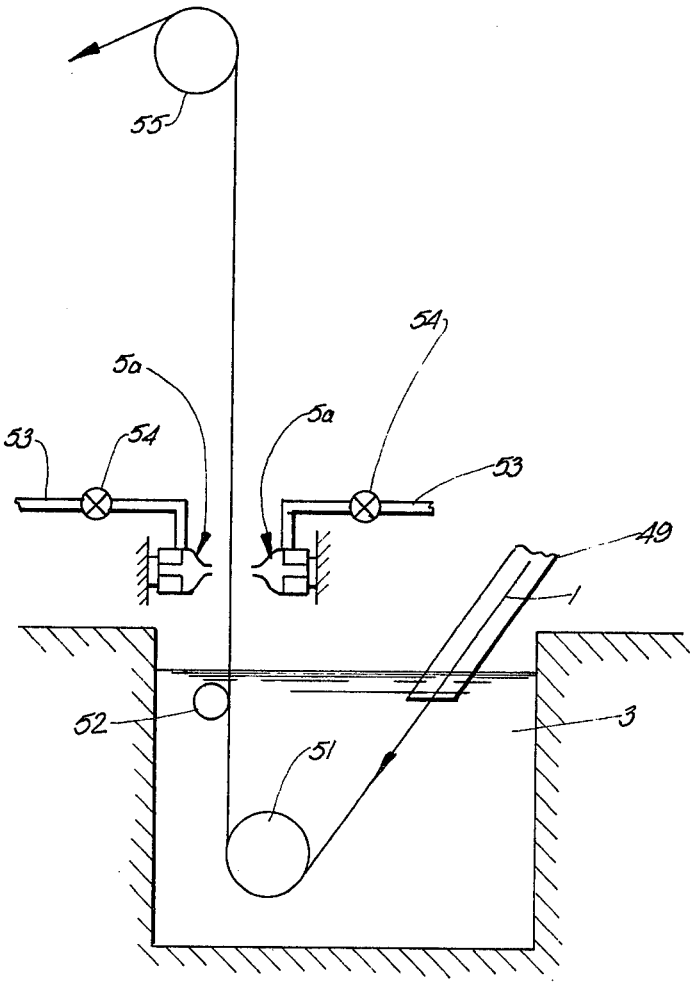

The theoretical dependence of the coating thickness on the nozzle-to-strip separation (provided $Z_o \geqq 8$ to $10d$) and the nozzle plenum pressure have been verified by controlled tests summarized in FIGS. 8 and 9. The strip speed dependence has been verified indirectly by examining laboratory and mill data. In particular it has been found that K-values calculated from experimental data using Equation (19) are adequate (within a standard deviation of about 25%) for estimating coating thickness over operational ranges such as those listed in Table III.

It is evident that the nozzle-to-strip separation has the greatest effect on the coating thickness. Since the nozzle-to-strip separation also has the largest convenient range of variation, this parameter is particularly effective for adjusting the basic coating thickness. The nozzle slot opening provides an effective parameter for adjusting the coating uniformity, since it can be varied across the width of the nozzle. Equation (1) indicates that the coating thickness can be made as small as desired by decreasing the nozzle-to-strip separation $Z_o$. However, for a given nozzle there exists the above-mentioned near-field region adjacent the nozzle exit, and experimentation has shown that little or no improvement in performance is achieved by reducing the nozzle-to-strip separation below this limit. Therefore the achievement of optimum performance, defined as the maximum coating thickness reduction for a given flow of jet finishing fluid, requires that the following condition be fullfilled:

$$Z_o = \phi d, \tag{20}$$

where $\phi d$ corresponds to the length of the near-field region. As noted previously, $\phi$ is equal to 8 to 10 for the two-dimensional subsonic turbulent flow from a properly designed nozzle.

Equation (20) can be combined with Equation (1) to yield an expression for the minimum coating thickness. There are two possibilities, depending on the available adjustments for a given facility. If there are no limitations on the nozzle-to-strip separation $Z_o$, then the nozzle slot $d$ is reduced to its minimum practical value (usually determined by clogging) and Equation (20) is written as $Z_o = \phi d_{min}$. Accordingly, Equation (1) becomes $$t_{MIN} = K\phi(Ud_{MIN})^{\frac{1}{2}}\left[\left(\frac{P_o}{P_A}\right)^{\frac{\gamma-1}{\gamma}} - 1\right]^{-\frac{1}{2}} \tag{21}$$

Conversely, if the primary limitation is on the nozzle-to-strip separation, then Equation (20) is written as $d = Z_{min}/\phi$ and Equation (1) becomes $$t_{MIN} = K(\phi UZ_{MIN})^{\frac{1}{2}}\left[\left(\frac{P_o}{P_A}\right)^{\frac{\gamma-1}{\gamma}} - 1\right]^{-\frac{1}{2}} \tag{22}$$

The value of 100 for a given nozzle and type of flow can be determined empirically as follows:

(A) Adjust the nozzle slot opening $d_{min}$ to the minimum practical value with respect to considerations such as clogging due to spattering of molten coating metal, then reduce the nozzle-to-strip separation $Z_o$ until no further reduction in coating weight occurs. Calculate $\phi$ from $\phi = Z_o/d_{min}$ and use this value with Equation (21) to estimate the influence of other parameters on coating weight.

(B) If the performance is still improving during the execution of adjustment A at the minimum nozzle-to-strip separation which is practical, then set $Z_o$ at this value and increase the nozzle gap opening $d$ until no further reduction in coating weight occurs. Calculate $\phi$ from $\phi = Zmin/d$ and use this value in Equation (22) to estimate the influence of other parameters on coating weight.

The above procedure provides a rapid and easy method for attaining optimum performance of a given finishing apparatus without laborious experimentation. When the values of Z and $d$ in a particular apparatus are adjusted so that Equation (20 ) is satisified, the coating thickness will be given by Equations (21) or (22), and will be the minumum thickness which can be obtained with a given jet flow. Consequently, the gas mass flow and the required plenum pressure ratio are minimized, and blower air can be used as the jet finishing medium.

The differences between the present method and the suggestions of the prior art can now be appreciated.

The prior art suggests that the mass of gas impinging against the molten coating is a dominant factor in determining the degree of jet finishing (coating thickness reduction for given strip speed). The present invention teaches that the degree of jet finishing is proportional to the momentum flux per unit width ($\rho_f W_o^2 d$) in the jet flow and not the mass flow per unit width ($\rho_f W_o d$). See Equation (16). There are practical significances to this distinction. The momentum flux per unit width in the jet is dependent almost entirely on the nozzle plenum pressure $\rho_o$; see Equation (17). Conversely the mass flux per unit width in the jet is also dependent on the static temperature $T_o$ of the gas in the plenum chamber, as seen by the following equation:

$$\rho_f W_o d = d\left[\frac{2\gamma}{R(\gamma-1)}\right]^{\frac{1}{2}} \frac{P_A}{\sqrt{T_o}}\left(\frac{P_o}{P_A}\right)^{\frac{\gamma-1}{\gamma}}\left[\left(\frac{P_o}{P_A}\right)^{\frac{\gamma-1}{\gamma}} - 1\right]^{-\frac{1}{2}} \tag{23}$$

where R is the universal gas constant. Thus, if mass flow were indeed a dominant factor in controlling the degree of jet finishing, then one would be led to the conclusion that a significantly higher nozzle plenum pressure would have to be used when working with superheated steam to compensate for the higher plenum static temperature (note that the static temperature is in the denominator of Equation (19)). The present method discloses, and experiments confirm, that the degree of jet finishing is independent of the plenum gas temperature and that such compensations are therefore not required.

Previously, it has been considered that the nozzle slot opening $d$ is not a critical parameter in the jet finishing process and that it can be conveniently enlarged to increase the mass flow and therefore to reduce the coating thickness. The present method teaches that if one is operating with $Z_o > \phi d$ — that is, at conditions that are not optimum — then a reduction in coating thickness can be achieved by increasing the nozzle slot opening (see Equation (1)), since such an adjustment increases the momentum flux per unit width in the jet flow (see Equation (17)). However if one is operating with the nozzle slot opening and the nozzle-to-strip distance adjusted for maximum performance — that is, according to Equations (21) and (22) — then increasing the nozzle slot opening can cause the near-field region to become extended so that the strip passes through the near-field region, and the jet finishing process is thereby adversely affected. Indeed, if practical limitations on the nozzle-to-strip separation permit, the method of this invention discloses that optimum jet finishing will be accomplished when the nozzle slot is reduced to its minimum practical value and the nozzle-to-strip separation is adjusted according to Equation (20).

The prior art suggests that, if all other parameters are held constant, the coating thickness should be proportional to the strip speed. This judgement is based on experimental observations over a limited range of strip speeds. The present method shows that the coating thickness should be proportional to the square root of the strip speed.

The prior art suggests that the resultant coating thickness is inversely proportional to the nozzle plenum pressure. The present method teaches that the resultant coating thickness is proportional to $$\left[\left(\frac{P_o}{P_A}\right)^{\frac{\gamma-1}{\gamma}} - 1\right]^{-\frac{1}{2}}.$$

This functional dependence has been confirmed experimentally (FIG. 9).

The present method indicates that the jet finishing capacity of a given jet flow is determined entirely by the maximum in the gradient of the stagnation pressure profile on the side of the profile that faces the oncoming strip. The general characteristics of the relationship between the coating fluid motion in the interaction region and the stagnation pressure profile are shown schematically in FIG. 4. It will be noted that most of the coating thickness reduction and the point of flow reversal occur ahead of the point of maximum pressure gradient $(dp/dx)_{max}$, and, in fact, that the remaining coating thickness at the point of $(dp/dx)_{max}$ is only 50% greater than the final solidified coating thickness $t$. There also exists a point 31 at a coating layer thickness equal to three times the final solidified coating thickness, where the surface flow velocity reverses directions.

A ripple is defined as a longitudinal coating thickness nonuniformity which appears in a transverse line pattern as curtains or sags. It is believed to be caused by nonuniform oxide formation on the finished coating at the point of jet impingement or wiping. When uniform oxide is allowed to flow onto the finished coating from the pneumatic dam, uniform coating thickness results. However, abnormally thick or thin oxide segments, if passed onto the finished coating, will result in variations of coating metal thickness. This problem is more severe at low strip speeds because of the longer oxidation time. The heat transfer rate between the jet finishing fluid and the molten coating can be shown to be proportional to the square root of the mass flow rate of the jet finishing flow. The surface oxidation kinetics are expected to obey a similar relationship. Therefore under given operating conditions a minimum ripple formation would result if the jet finishing flow rate can be reduced, so that the oxide layer can remain thin and break up evenly. The present method provides criteria for adjusting jet finishing systems to achieve given degrees of jet finishing with minimum jet flow rates.

In accordance with this invention, the jet finishing capacity at a given distance from the nozzle in a given jet flow is determined entirely by the maximum lateral gradient in the flow stream momentum flux at the point in question. Since the maximum gradient in momentum flux is proportional to the momentum flux per unit width of the jet flow and inversely proportional to the distance from the nozzle exit, the jet finishing capacity decreases with distance from the nozzle exit. Furthermore, the method teaches that, for a given nozzle, operating under given conditions, there is a region adjacent to the nozzle exit (near-field region) where the free jet flow is not effective for jet finishing. That is, no improvements in jet finishing capacity are achieved by moving the point of passage of the strip through the jet, to a point closer to the nozzle exit, if this new point of passage is within the near-field region. Therefore a given jet, with a given momentum flux per unit width, possesses a maximum capacity for jet finishing. This maximum degree of jet finishing for a given momentum flux per unit width is achieved when the strip is passed through the far field region at the closest proximity to the near-field boundary. It will be appreciated that the momentum flux per unit width is constant throughout a free jet flow. It is possible, of course, to increase the maximum jet finishing capacity by increasing the momentum flux per unit width. Equation (17) teaches that this may be done by increasing the nozzle slot gap $d$ or by increasing the plenum pressure ration $\rho_0/\rho_A$. However, the present method shows that the nozzle slot gap is not the appropriate parameter for achieving an increase in the maximum jet finishing capacity, since an increase in the nozzle slot gap also results in an associated increase in the length of the near-field region, the net result of which is a loss in maximum jet finishing capacity when the strip position is readjusted back into the far-field. Thus an increase in the plenum pressure is generally the appropriate parameter for increasing the maximum jet finishing capacity of the flow. However, there is also a maximum desirable plenum or nozzle pressure ratio. If the plenum pressure is increased to the point where the nozzle pressure ratio obeys the relationship $$\left(\frac{P_o}{P_4}\right)_{CRITICAL} = \left(\frac{\gamma+1}{2}\right)^{\frac{\gamma}{\gamma-1}}, \quad (24)$$

then the flow velocity at the nozzle throat is equal to the acoustic velocity, and the nozzle flow is said to be choked, since subsequent increases in plenum pressure do not increase the flow velocity at the nozzle throat. In a converging nozzle of the type generally used for jet finishing, the pressure at the throat is equal to the atmospheric pressure when the flow is subsonic, i,e., when the plenum pressure is below the critical value given by Equation (24). When the plenum pressure is raised above the critical pressure and the flow becomes sonically choked at the throat, then the pressure at the throat becomes larger than the atmospheric pressure. Consequently, the static pressure within the flow stream which emerges from such a sonically choked nozzle is above that of the surrounding atmosphere. This pressure differntial causes a lateral expansion of the free jet flow, which has the undesirable effect of lengthening the near-field region, i.e., of spreading out the large gradients in momentum flux which might otherwise be expected to exist in the velocity of the nozzle exit. Thus, although high momentum fluxes can be generated by using high plenum pressures, most effective use can be made of a given jet finishing flow by subsonic operation. Subsonic nozzle flow can provide sufficient jet finishing capacity for most applications if the strip passage is properly situated at the near-field/far-field boundary. For example, if the condition of Equation (24) is substituted into Equation (21), one obtains the following limitation imposed by the requirement of subsonic nozzle flow:

$$t_{CRIT.} > 2\left(\frac{2}{\gamma-1}\right)^{\frac{1}{2}} K\phi\,(Ud_{MIN})^{1/2}. \quad (25)$$

For a $K = g \times 10^{-6}$ sec, $\gamma = 1.4$, $\phi = 8$, $U = 500$ fpm, and $d = 0.05$ inch, Equation (25) yields a coating weight of about 0.22 oz/ft$^2$.

In contrast to this, some prior art nozzle means are configured with $d < Z_{min}/\phi$. Consequently, a high nozzle pressure ratio and choked flow are required in order to compensate for the small value of $d$ and to generate the required momentum flux; see Equation (17).

The analytical description of the jet finishing process described above also leads directly to the design of effective jet finishing nozzles.

Figure 10:
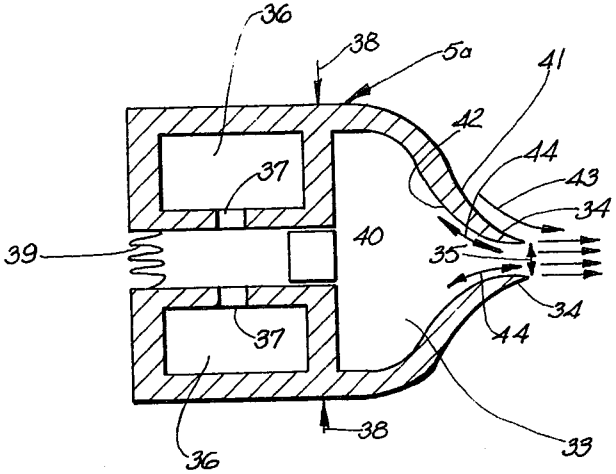
FIG. 10 is a vertical sectional view of a fluid jet nozzle embodying the present invention.

Referring to FIG. 10 of the drawings, a fluid jet nozzle in accordance with the invention is indicated generally at 5*a*. A nozzle plenum chamber is indicated at 33 which communicates directly with a pair of upper and lower lips 34 defining therebetween an orifice 35 through which the primary nozzle flow is discharged in the form of an elongated fluid jet having a width at least equal to the width of the coated strip which is being treated. A pair of gas inlet plenum chambers 36 is preferably provided, which communicate with a source of fluid under pressure (not shown), each inlet chamber being provided with an inwardly facing outlet 37 extending substantially the length thereof, which assures a uniform supply of gas along the length of the main plenum chamber 33.

Means for adjusting the size of the orifice 35 are shown diagrammatically in FIG. 10, in which a body force 38 is imposed externally and transversely along the nozzle body. The nozzle body may consist of two halves joined to permit flexing but sealed by a bellows 39 or other suitable means to prevent leaks from the plenum 33. Shims 40 may be provided on the inner surface at the nozzle body ends and center to provide stops for regulating the size of the discharge opening. Each shim thickness is in proportion to the gap opening desired on the ends and in the middle. These means form no part of the present invention and may, for example, be of the type disclosed in the above-mentioned Kohler U.S. Pat. No. 3,314,163.

Both the external and internal configuration of the nozzle structure in the region of the main plenum chamber and the discharge lip are designed to eliminate or minimize vena contracta losses, friction losses, and the base pressure region adjacent to the discharge, thereby shortening the near-field zone. More specifically, a concave external surface 41 merging smoothly into the lip 34 permits entrained gas, ordinarily atmospheric air, to flow smoothly into the primary flow stream. A corresponding convex internal surface 42 forming a rounded entrance to the nozzle lips 34 and the orifice 35 therebetween minimizes vena contracta losses. The smooth flow of entrained gas down the concave surface 41 is illustrated diagrammatically by an arrow 43 in FIG. 10.

The short and gradually converging throat section indicated by a double-headed arrow 44 in FIG. 10 minimizes friction losses. This is in sharp contrast to the elongated constant-gap channel at the throat provided in the above-described Mayhew and Hunter et al. nozzle structures.

It will be understood that high efficiency in removal of excess coating metal is dependent upon the creation of a large gradient in momentum flux in the lateral direction. The external configuration of the nozzle of the present invention contributes to attaining this objective by causing entrained gas to flow generally parallel to the primary flow discharge from the nozzle orifice, thereby achieving a minimum of large scale turbulence at the nozzle exit. By providing a minimum generation of large scale turbulence during the initial interaction with the ambient entrained gas at the nozzle exit, the near-field region is shortened. Since the gradient in momentum flux decreases with the distance from the nozzle exit, a decrease in the length of the near-field region makes it possible to position the nozzle exit closer to the strip and thereby obtain a high gradient in momentum flux.

The internal convex surface 42 is arcuate and is formed with a radius of curvature of the same order of magnitude as the orifice or gap 35, which can vary between about 0.03 inch and about 0.20 inch. As indicated above, this minimizes vena contracta losses.

Figure 11:
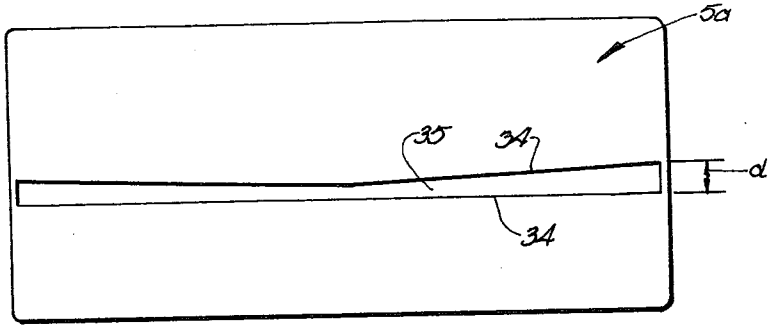
FIG. 11 is a diagrammatic representation of the jet nozzle orifice of FIG. 10.

Reference is made to FIG. 11, which illustrates diagrammatically the progressive increase in the narrow dimension of the orifice or nozzle gap 35 from the center toward each end thereof. The progressive variation may be linear, arcuate, or parabolic. For purposes of an exemplary showing, a linear variation is disclosed in FIG. 11, which is the same as that shown in the above-mentioned Armco Steel Corporation British Pat. No. 1,304,532. The narrow dimension $d$ at each end of the slot is so adjusted as to satisfy a preferred value with respect to the nozzle-to-strip spacing $Z_o$ in accordance with the equation $d = \phi/Z_o$. Since the jet flow is most effective under these conditions because of a large gradient in momentum flux in the lateral direction, minimum coating thickness is obtained, and edge build-up is avoided. In contrast to this, the narrower orifice opening in the center of the nozzle may have a $d$-value considerably smaller than the optimum defined by the relationship $d = \phi/Z_o$, with the result that a progressively thicker coating will be obtained over the central portion of the coated strip.

FIG. 5 represents diagrammatically the type of fluid flow developed by a nozzle having outer walls 45 defining an orifice 46 having the narrow dimension $d$, under conditions of subsonic operation. Vertical turbulence is generated in the initial mixing zone 26 because of the potentially violent interaction between the flow stream and ambient gas at the nozzle exit. The effects of this interaction prevail throughout the near-field region. Velocity profiles are shown at 27 in the near-field transition mixing region and at 28 in the far-field region. The momentum profiles are proportional to the square of the velocity profiles. Therefore it will be apparent that FIG. 5 indicates that the maximum gradient of the momentum flux at a point 47 just into the far-field region will be larger than the maximum gradient of the momentum flux in the near-field transition mixing region at 27. Since the jet finishing capacity at a given point in a given flow, is proportional to the maximum gradient in the momentum flux, it follows that the near-field region should be no more effective and perhaps less effective than the far-field region for jet finishing. Experimentation indicates that this is the case. This illustrates why optimum coating metal finishing performance is achieved when the strip is passed through the far-field region in a plane adjacent the near-field boundary.

A near-field region must exist for any jet flow passing from a nozzle into a stationary ambient. The illustration shown in FIG. 5 should be considered representative of the basic transition which must occur in the process of generating a quiescent far-field flow. The existence of an unfavorable external nozzle structure in the vicinity of the nozzle exit can result in the generation of large scale turbulence, and in addition, can make it difficult for the external flow from the ambient gas to be smoothly entrained into the flow stream, thus resulting in the development of a lateral pressure differential which in turn causes an undesirable lateral flow of the fluid (base pressure pumping). Similarly, the existence of an elevated static pressure in the flow stream leaving the nozzle exit, because of a condition of sonically choked flow in the nozzle throat, also creates a lateral pressure gradient which induces an undesirable pressure-driven lateral expansion of the jet flow. These processes are all expected to extend the length of the near-field region beyond the minimum necessary for the basic flow transition. The nozzle of the present invention decreases the length of the near-field region, so that passage of the strip through the far-field in a plane adjacent to the near-field boundary results in subjecting the molten coating to a relatively large gradient in momentum flux in the lateral direction.

The method and apparatus of the present invention obtains maximum usage of a given flow stream momentum flux, generated with a given nozzle pressure ratio. Therefore an advantage of the present invention is that ambient air pressurized by a high volume blower can be used as a working gas in lieu of superheated steam or heated air. The use of ambient air rather than superheated steam results in the following advantages: (1) there is a signficant reduction in the noise level, typically of the order of 5 decibels; (2) operator safety and comfort is improved because of the elimination of the heat and blinding effect of condensing steam on face shields and glasses, with the result that the jet nozzles may be positioned with greater precision; and (3) corrosion of the equipment and associated building from the effects of condensed steam is eliminated.

FIG. 12 illustrates diagrammatically an otherwise conventional coating line in which the jet nozzles and method of the present invention may be utilized. A molten metal coating bath is shown at 3 in which the end of a hood 49 containing a protective atmosphere is submerged. A thoroughly cleaned strip 1 from a conventional preliminary treatment (not shown) is passed through hood 49 beneath the surface of the coating metal bath around roll 51 and withdrawn in a generally vertical path from the coating metal bath, the pumping action of the moving strip carrying with it an excess of molten coating metal. A stabilizing roll 52 is provided positioned slightly below the level of the coating metal bath in order to insure that the coated strip will be maintained flat at the plane of impingement of the fluid jet on each side thereof, the jet nozzle being shown generally at 5*a* and having the same construction as described above in connection with FIG. 10. Air under pressure is conducted from a blower (not shown) through a conduit 53 to each nozzle 5*a*. Valve means 54 is provided in each conduit 53 for controlling the gas mass flow.

The nozzle structure may be supported on each side of the strip in any conventional manner, and preferably the support structure will include means for positioning each nozzle relative to the strip and relative to the level of the coating metal bath, in conventional manner.

After passing between the fluid jet nozzles, the finished coated strip is conducted upwardly for a distance sufficient to insure solidification of the coating metal, passed around a roll 55 and conducted to a coiling and/or shearing apparatus (not shown).

The pretreatment of the strip prior to entering the coating metal bath in order to make the surface thereof receptive to the molten coating metal may be any of the conventionally used methods, such as the Sendzimir oxidation-reduction method, the Armco-Selas method, or a chemical cleaning method. Regardless of the type of pretreatment, the strip is preferably brought up to approximately the temperature of the molten coating metal bath, which in turn is preferably maintained at about 50° to 100° F above the melting point of the particular coating metal.

In a conventional commercial coating line of the general type illustrated in FIG. 12 and operated in accordance with prior art practice, the following operating conditions were observed.

For applying galvanized coating onto 20 gauge, 30-inch-wide strip, at a line speed of 105 feet per minute, 56-inch wide fluid jet nozzles, having orifice openings of 0.125 inch at each edge and 0.075 inch at the center, were positioned 1 inch to 2½ inches from the strip. The nozzles used were similar to the type disclosed in the above-mentioned Kohler U.S. Pat. No. 3,314,163. Superheated steam was used as a jet finishing fluid. A plenum pressure of 4.25 to 7.5 psig was used, and the nozzles were positioned about 12 inches above the level of the molten zinc bath to prevent excessive disturbance of the bath surface. Under these conditions ripples in the coating and edge build-up of coating metal occurred.

In the run described above, the nozzle pressure ratio $P_o/P_a$ varied between 1.28 and 1.51. The steam mass flow rate per unit area was about 1.0 slug/ft²-sec. The parameter $Z_o/d$ varied from about 10 at the strip edge, when the nozzle-to-strip separation $Z_o$ was 1 inch, to about 33 at the strip center when $Z_o$ was equal to 2½ inches. Another test was run, applying the teachings of this invention, wherein the nozzle slot was reduced to 0.115 inch at each end and 0.065 inch at the center. The nozzle-to-strip separation was reduced to ½ inch and the nozzles were located 4 inches above the zinc bath. This nozzle-to-slot separation provided a near optimum $Z_o/d$ value of 8 at the strip center, but violated the $Z_o/d$ criterion at the edges, provided a value of about 5.5. These adjustments permitted the plenum pressure to be reduced to 2.7 psig, which yielded a nozzle pressure ratio of 1.18 and a steam mass flow rate of about 0.85 slug/ft²-sec. The line speed was maintained at 105 feet per minute. Operation under these conditions resulted in a coating weight of 0.42 oz/ft² of the strip with virtual elimination of ripples although some coating was left on the strip edge. The surface appearance was far superior to that of the prior art product. The noise level in the coating pot area was significantly reduced, as was the top dross formation. In general the finishing operation was by far the best which had ever been accomplished on this coating line. The formation of some edge build-up in this run was to be expected, since the $Z_o/d$ criterion was not satisfied at the strip edges, i,e., they apparently passed into the less effective near-field region of the jet flow.

Another run was conducted with the nozzle orifice reduced at 0.100 inch at each edge and 0.05 inch at the center, with the nozzles positioned ½ inch from the strip and 4 inches above the zinc coating metal bath. This raised the $Z_o/d$ value at the center of the strip to 10 and at the edge of the strip to 6.5. At a line speed of 105 feet per minute and a plenum pressure of 2.6 psig, coating weights of 0.40 to 0.45 oz/ft² were produced with the same improvements noted above in elimination of ripples and improved surface appearance.

Subsequent runs were made under the same conditions using 25 gauge, 48-inch-wide strip and 20 gauge, 42-inch-wide strip as opposed to the 30-inch-wide strip used in the runs described above. The edges of the wider strip passed by wider regions of the nozzle slot and therefore constituted more extreme violations of the $Z^o/d$ criterion than the cases discussed above. The resultant coatings exhibited edge build-up and a bad coating profile.

In another experimental run producing a so-called minimized spangel zinc-coated product by the method disclosed in U.S. Pat. No. 3,379,557 to G. R. Hoover et al., wherein sub-macroscopic spangling is induced by applying solidification nuclei to the finished molten zinc coating when it is at a temperature just above the solidification point, the following operating conditions were used:

The nozzle orifices were adjusted to 0.065 inch at each edge and 0.030 inch at the center. The nozzles were positioned ¾ inch from the strip and 4 inches above the bath. The line speed was 90 feet per minute, and the plenum pressure was from 2 to 2.5 psig. The coating weight averaged 0.93 oz/ft². The surface quality of this product was good, the formation of ripples being eliminated. However, edge build-up was barely avoided at this extremely low line speed.

The method of the present invention indicates that the observed edge build-up could have resulted from a failure to observe the $Z_o/d$ criterion, i.e., that the edge of the strip might have passed through the near-field region, and that the problem might be resolved by a slight reduction in the nozzle slot *d*. Accordingly, the above run on minimized spangle zinc coating was repeated with a modification in the orifice openings of 0.070 inch at each end and 0.04 inch in the center will all other conditions remaining the same. The resulting product had an average coating weight of 0.96 oz/ft², optimum surface quality, with no ripples, and edge build-up was completely eliminated.

As will be evident from Table III above, broad operating ranges suitable for conventional coating metals are as follows:

Orifice gap (narrow dimension): 0.25–0.15 inch
Nozzle-to-strip distance: 0.25–2.5 inch
Plenum pressure: 0.5–10 psig For line speeds of not greater than 170 feet per minute the preferred operating parameters for galvanized coatings have been found to be as follows:

Orifice gap 0.07–0.10 inch at ends and 0.04–0.06 inch at center.

Nozzle-to-strip distance 0.5 to 1 inch.

Nozzles positioned in directly opposed relation substantially vertical to the strip surface.

Plenum pressure 0.5 to 4.25 psig, using ambient air.

It has been found that low pressure and close positioning of the jet nozzles to the strip are effective in elimination of ripples but are conductive to edge build-up. Accordingly, at slow speeds, there is a minimum pressure and nozzle-to-strip distance which must be observed in order to avoid edge build-up. Empirically, for zinc coating these have been determined to be about 0.5 psig and ½ inch, respectively.

The invention has thus solved the problems of ripple formation and edge build-up at slow line speeds. However, the utility of the invention is not so limited, and the teachings thereof are beneficial in obtaining optimum jet finishing at high speeds, even above those now practiced.

The embodiments of the invention in which an exclusive property or privilege is claimed are defined as follows:

1. In a method of finishing a molten metallic coating on a moving metallic strip, said metallic coating being chosen from the group consisting of zinc, aluminum, alloys of zinc, alloys of aluminum, and terne, wherein an elongated jet of gaseous fluid at subsonic velocity is discharged from a nozzle and caused to impinge across an upwardly moving coated strip substantially normal thereto at a point where the coating is molten and where the thickness of the coating is in excess of the desired final coating thickness, and wherein the narrow dimension of said jet is increased progressively from the center toward each edge thereof by contouring the narrow dimension of said nozzle, the improvement which comprises obtaining optimum finishing performance in a given finishing apparatus by adjusting the narrow dismension of the nozzle at the strip edge to the minimum practical value ($d_{min}$) with respect to clogging, reducing the nozzle-to-strip separation ($Z_o$) until no further reduction in coating thickness occurs, satisfying the relation $$Z_o = \phi\, d$$

where $z_o$ = distance from nozzle to strip, $\phi$ = length of near-field region expressed as a multiple of $d$, $d$ = narrow dimension of nozzle at strip edge, calculating $\phi$ from $\phi = Z_o d\min$, substituting the value of $\phi$ in the equation $$t_{min} = K\phi(Ud_{min})^{\frac{1}{2}}\left[\left(\frac{P_O}{P_A}\right)^{\frac{\Gamma-1}{\Gamma}} - 1\right]^{-\frac{1}{2}}$$

where $t_{min}$ = minimum coating thickness $K$ = constant which depends on the viscosity of the molten coating metal, the efficiency of the nozzle, and the ratio of specific heats of the gaseous fluid $U$ = strip speed, $p_o$ = gas pressure in the nozzle plenum, $p_A$ = ambient (atmospheric) pressure, $\gamma$ = ratio of specific heats of the gaseous fluid, and minimizing the ratio $p_o p_A$ for a desired minimum coating thickness.

2. The improvement claimed in claim 1, wherein the nozzle efficiency is about 1, and wherein $\phi$ = 8 to 10.

3. The improvement claimed in claim 2, wherein $Z_o$ = 0.25 to 2.5 inches.

4. The improvement claimed in claim 1, wherein $d$ = 0.025 to 0.15 inch.

5. The improvement claimed in claim 1, wherein said fluid is air at ambient temperature and is supplied from a blower to provide a pressure of about 0.5 to about 10 psig inside said nozzle.

6. The improvement claimed in claim 1, wherein said coating metal is zinc, wherein the nozzle efficiency is about 1, wherein $\phi$ = 8 to 10, $Z_o$ = 0.5 to 1 inch, $d$ = 0.07 to 0.10 inch, and wherein said fluid is ambient air and is supplied to said nozzle at a pressure of about 0.5 to about 4.25 psig.

7. In a method of finishing a molten metallic coating on a moving metallic strip, said metallic coating being chosen from the group consisting of zinc, aluminum, alloys of zinc, alloys of aluminum, and terne, wherein an elongated jet of gaseous fluid at subsonic velocity is discharged from a nozzle and caused to impinge across an upwardly moving coated strip substantially normal thereto at a point where the coating is molten and where the thickness of the coating is in excess of the desired final coating thickness, and wherein the narrow dimension of said jet is increased progressively from the center toward each edge thereof by contouring the narrow dimension of said nozzle, the improvement which comprises obtaining optimum finishing performance in a given finishing apparatus by adjusting the narrow dimension of the nozzle at the strip edge to minimum practical value ($d_{min}$) with respect to clogging, reducing the nozzle-to-strip separation $Z_o$ to the minimum practical value ($Z_{min}$), increasing the narrow dimension of the nozzle $d$ until no further reduction in coating thickness occurs, satisfying the relation $Z_o = \phi\, d$ where $Z_o$ = distance from nozzle to strip, $\phi$ = length of near-field region expressed as a multiple of $d$, $d$ = narrow dimension of nozzle at strip edge, calculating $\phi$ from $\phi = Z_{min}/d$, substituting the value of $\phi$ in the equation $$t_{min} = K(\phi U Z_{min})^{\frac{1}{2}}\left[\left(\frac{P_o}{P_A}\right)^{\frac{\gamma-1}{\gamma}} - 1\right]^{-\frac{1}{2}}$$

where $t_{min}$ = minimum coating thickness $K$ = constant which depends on the viscosity of the molten coating metal, the efficiency of the nozzle, and the ratio of specific heats of the gaseous fluid $U$ = strip speed, $p_o$ = gas pressure in the nozzle plenum, $P_A$ = ambient (atmospheric) pressure, $\gamma$ = ratio of specific heats of the gaseous fluid, and minimizing the ratio $p_o/p_A$ for a desired minimum coating thickness.

8. The improvement claimed in claim 7, wherein the nozzle efficiency is about 1, and wherein $\phi$ = 8 to 10.

9. The improvement claimed in claim 8, wherein $Z_o$ = 0.25 to 2.5 inches.

10. The improvement claimed in claim 7, wherein $d$ = 0.025 to 0.15 inch.

11. The improvement claimed in claim 7, wherein said fluid is air at ambient temperature and is supplied from a blower to provide pressure of about 0.5 to about 10 psig inside said nozzle.

12. The improvement claimed in claim 7, wherein said coating metal is zinc, wherein the nozzle efficiency is about 1, wherein $\phi$ = 8 to 10, $Z_o$ = 0.5 to 1 inch, $d$ = 0.07 to 0.10 inch, and wherein said fluid is ambient air and is supplied to said nozzle at a pressure of about 0.5 to about 4.25 psig.

* * * * *